US009331407B2

(12) United States Patent
Laurx et al.

(10) Patent No.: US 9,331,407 B2
(45) Date of Patent: May 3, 2016

(54) CONNECTOR AND CONNECTOR SYSTEM WITH GROUNDING SYSTEM

(71) Applicant: Molex, LLC, Lisle, IL (US)

(72) Inventors: John C. Laurx, Aurora, IL (US); Peerouz Amleshi, Lisle, IL (US); Vivek M. Shah, Buffalo Grove, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/351,064

(22) PCT Filed: Oct. 12, 2012

(86) PCT No.: PCT/US2012/059975

§ 371 (c)(1),
(2) Date: Apr. 10, 2014

(87) PCT Pub. No.: WO2013/056066

PCT Pub. Date: Apr. 18, 2013

(65) Prior Publication Data

US 2014/0370723 A1 Dec. 18, 2014

Related U.S. Application Data

(60) Provisional application No. 61/546,421, filed on Oct. 12, 2011.

(51) Int. Cl.

| | |
|---|---|
| ***H01R 13/648*** | (2006.01) |
| ***H01R 12/72*** | (2011.01) |
| ***H01R 13/6587*** | (2011.01) |
| ***H01R 13/6581*** | (2011.01) |

(52) U.S. Cl.

CPC ..... *H01R 12/722* (2013.01); *H01R 13/6581* (2013.01); *H01R 13/6587* (2013.01)

(58) Field of Classification Search

CPC ..... H01R 12/722; H01R 13/6581; H01R 13/6587; H01R 12/72

USPC ..... 439/76.1, 79, 607.07, 607.09, 607.05, 439/628

See application file for complete search history.

(56) References Cited

U.S. PATENT DOCUMENTS

| | | | | |
|---|---|---|---|---|
| 6,347,962 | B1 | 2/2002 | Kline | |
| 6,431,914 | B1 | 8/2002 | Billman | |
| 7,618,289 | B2 * | 11/2009 | Rothermel et al. | 439/607.07 |
| 7,946,871 | B1 | 5/2011 | Yu et al. | |
| 7,976,318 | B2 | 7/2011 | Fedder et al. | |
| 8,446,678 | B2 | 5/2013 | Mihara | |
| 8,628,356 | B2 | 1/2014 | Laurx et al. | |

(Continued)

FOREIGN PATENT DOCUMENTS

| | | | |
|---|---|---|---|
| CN | 201690023 | U | 12/2010 |
| CN | 201918521 | U | 8/2011 |
| JP | 2008-280492 | A | 11/2008 |
| JP | 2009-048899 | | 3/2009 |
| WO | WO 2010/039188 | A1 | 4/2010 |

*Primary Examiner* — Javaid Nasri
(74) *Attorney, Agent, or Firm* — Stephen L. Sheldon

(57) ABSTRACT

A connector system is disclosed that includes a first and second connector. The first connector supports a channel terminal that is U-shaped and includes a mating edge. The second connector includes one or more wafers that support terminals arranged in an edge-coupled manner. Ground terminals in the one or more wafers are configured to engage the mating edge of the channel terminal. Each wafer can include a shield mounted on a side of the wafer. If desired, the ground terminal, the channel terminal and the shield can be electrically connected in the mating interface.

20 Claims, 24 Drawing Sheets

(56) References Cited

U.S. PATENT DOCUMENTS

| | | | | |
|---|---|---|---|---|
| 2003/0124881 | A1 | 7/2003 | Avery et al. | |
| 2008/0280492 | A1 | 11/2008 | Rothermel et al. | |
| 2009/0227141 | A1 | 9/2009 | Pan | |
| 2011/0021082 | A1 | 1/2011 | Kline | |
| 2014/0370723 | A1* | 12/2014 | Laurx | H01R 13/6587 439/76.1 |

* cited by examiner

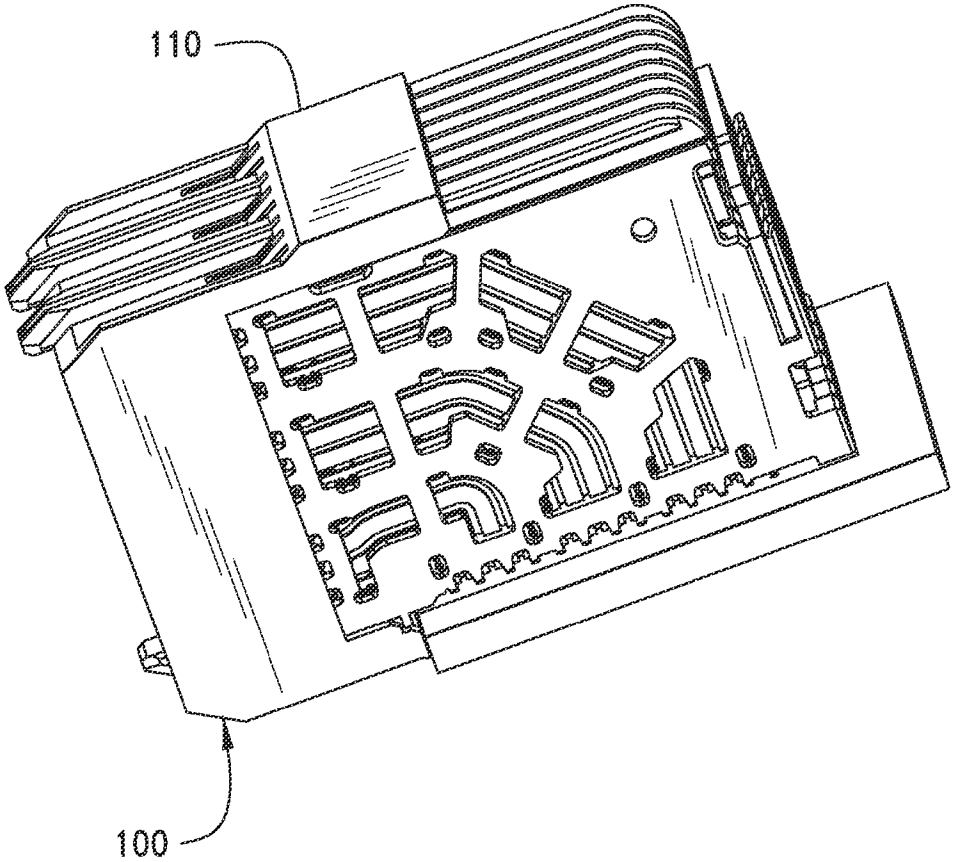
FIG.2
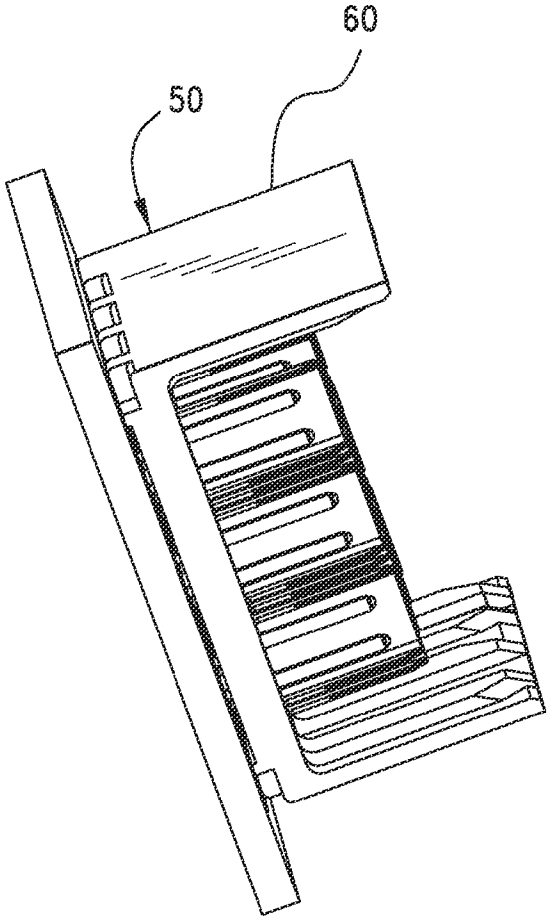

CONNECTOR AND CONNECTOR SYSTEM WITH GROUNDING SYSTEM

RELATED APPLICATIONS

This application claims priority to U.S. Provisional Application No. 61/546,421, filed Oct. 12, 2011, which is incorporated herein by reference in its entirety.

FIELD OF THE INVENTION

The present invention relates to the field of connectors, more specifically to the field of connector suitable for high data rates.

DESCRIPTION OF RELATED ART

Backplane connectors are often used to support high performance applications. While backplane connectors originally were mostly used in single-ended channels applications, most recent designs have migrated to providing differential signal pairs (as differential signal pairs inherently have greater resistance to spurious signals). Backplane connectors that are used to support systems that use high data rates thus tend to be configured to utilize a number of differential signal pairs. Because different applications require different numbers of data channels, backplane connectors often are provided in a configuration that includes a header (which is mounted on a first circuit board) and a daughter card connector (which is mounted on a second circuit board) that supports a number of wafers (which in turn provides some desired number of signal pairs). The number of signal pairs in the wafer can be adjusted, as well as the size of the housing of the header and the size of the housing of the daughter card connector. Thus, existing backplane connectors are able to offer substantial benefits to applications that can benefit from the performance capabilities.

As processing power and the desired rate of information transfer from one device to another increases, however, further improvements to the performance of backplane connectors will be helpful. In addition to performance improvements, extremely dense connectors (e.g., connectors with a large number of pins per area) are desirable. Thus, certain individuals would appreciate further improvements to connectors that are suitable to function as backplane connectors.

BRIEF SUMMARY

In an embodiment, a connector system is disclosed that includes a first and second connector. The first connector includes a housing that supports a channel terminal that is U-shaped and includes a mating edge. Two blade terminals can be positioned in the U-shaped region defined by the channel terminal. The second connector includes one or more wafers that support terminals arranged in an edge-coupled manner. Ground terminals in the one or more wafers are configured to engage the mating edge of the channel terminal. Each wafer can include a shield and the ground terminal, the channel terminal and the shield can be electrically connected in the mating interface.

In another embodiment, a connector is provided that includes a housing that supports a plurality of wafers. The wafers can include a shield and support a plurality of signal terminals, which are provided in pairs, and ground terminals positioned between the pairs of signal terminals. The shield can be electrically connected to the ground terminals. The ground terminals can have ground contact that have two beams, each beam having a contact surface facing in an opposite direction. If desired, the two beams can extend in different directions on opposite sides of a terminal centerline. The shield can include a groove that is aligned with a signal pair. If desired, the groove can be configured with fingers that are configured to be electrically connected to ground terminals that are positioned on opposite sides of the signal pair.

BRIEF DESCRIPTION OF THE DRAWINGS

The present invention is illustrated by way of example and not limited in the accompanying figures in which like reference numerals indicate similar elements and in which:

FIG. 2 illustrates a partially exploded view of the embodiment depicted in FIG. 1.

DETAILED DESCRIPTION

Figure 1:
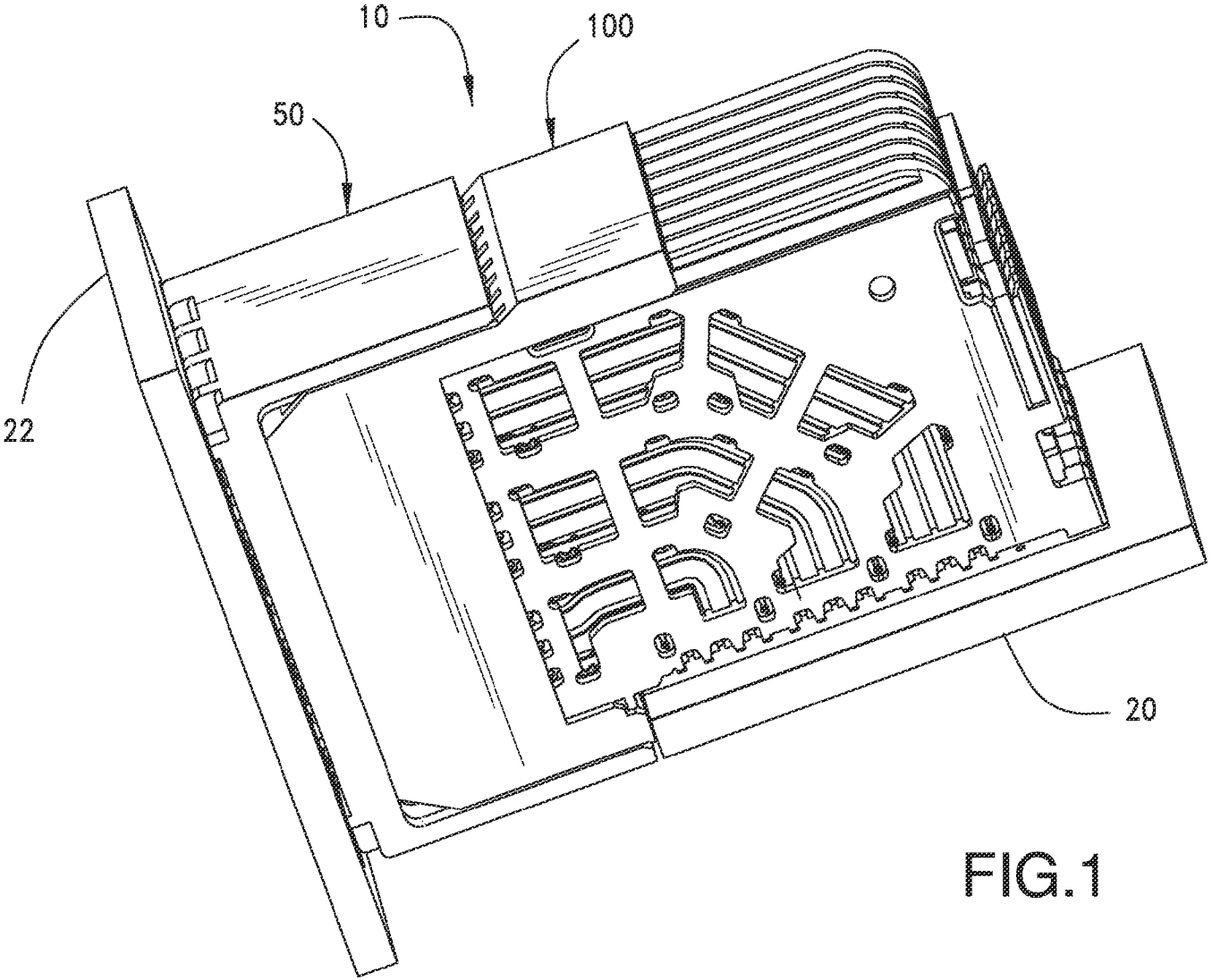
FIG. 1 illustrates a perspective view of an embodiment of a connector system.
Figure 3:
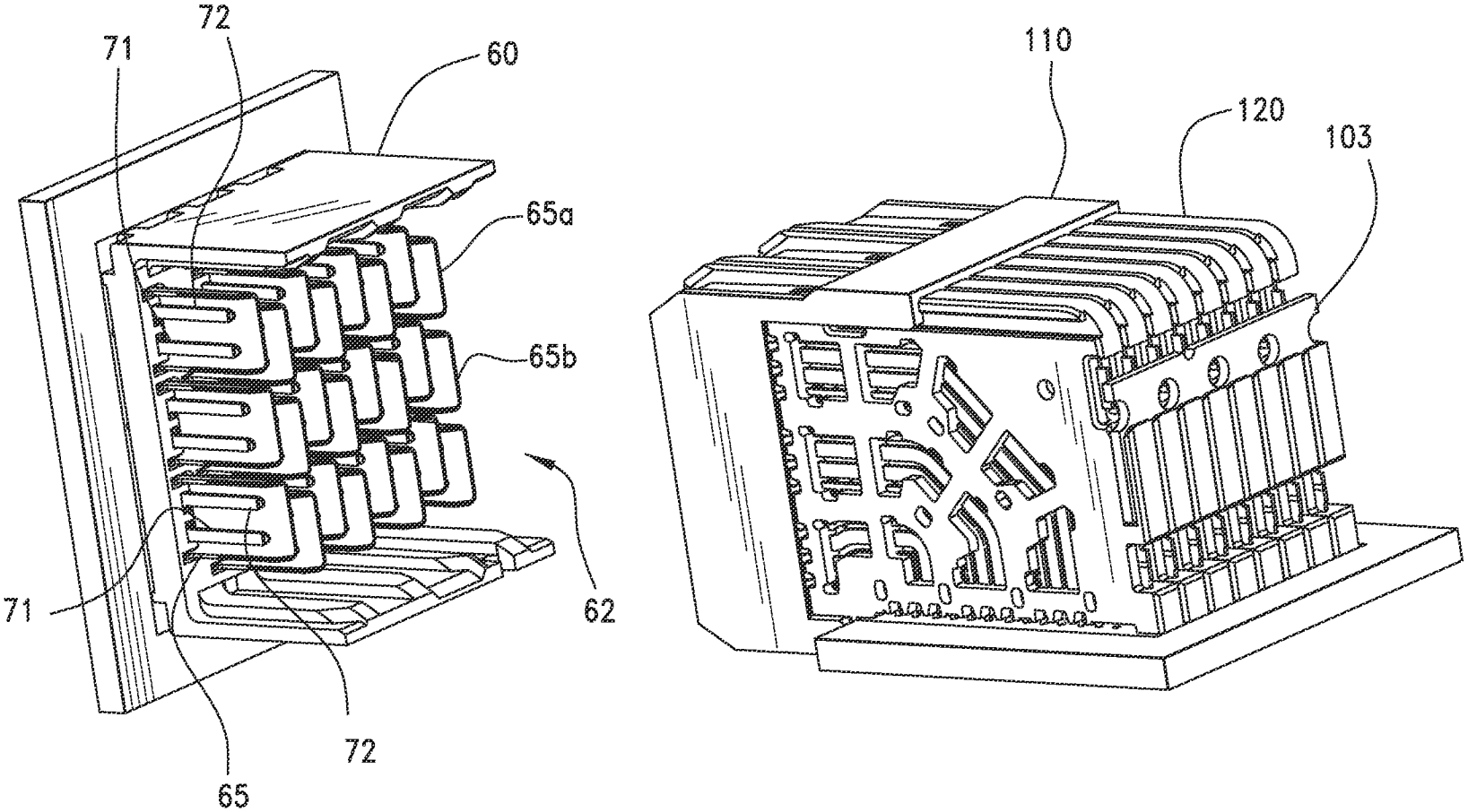
FIG. 3 illustrates another perspective view of the embodiment depicted in FIG. 2.
Figure 4:
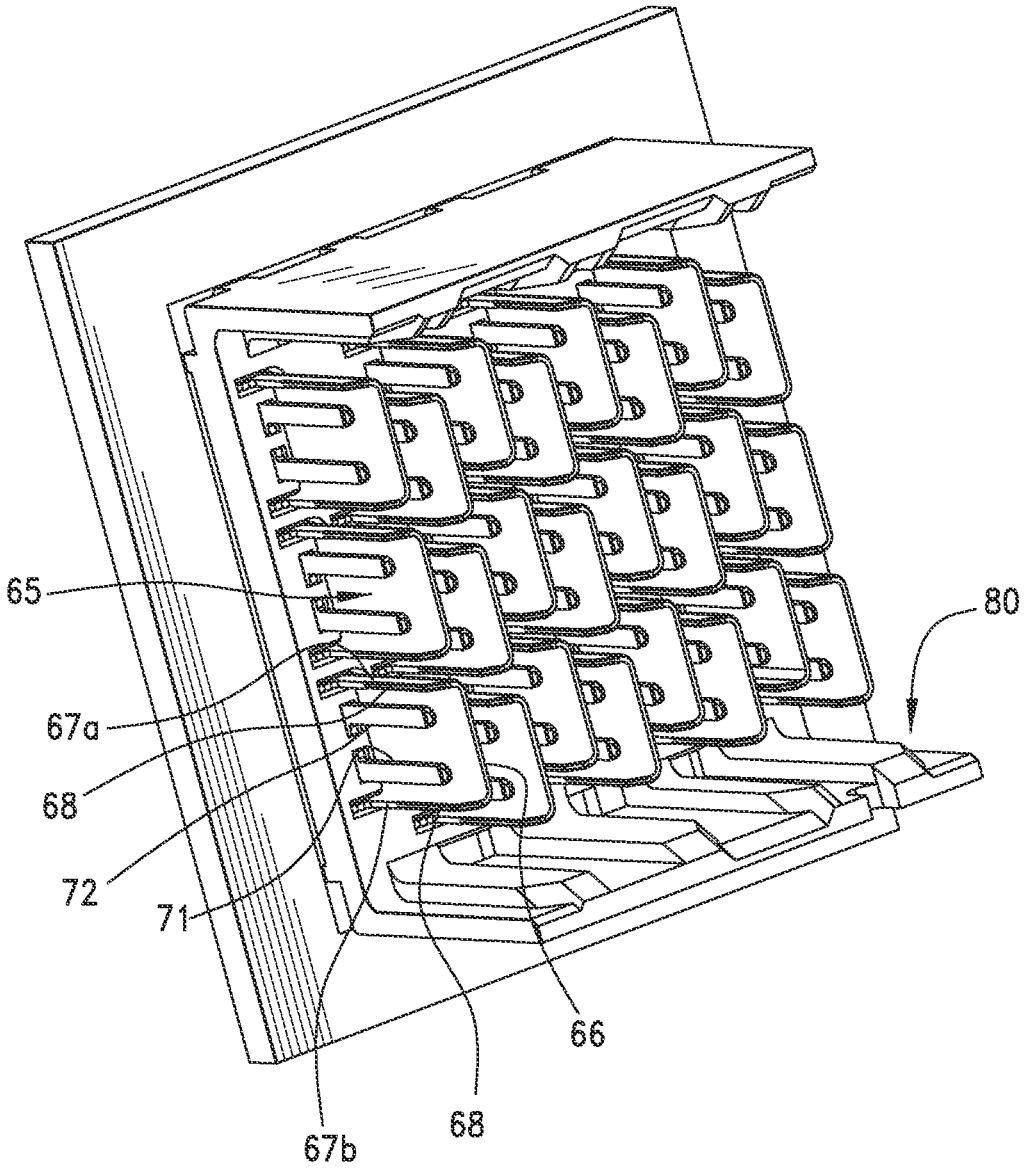
FIG. 4 illustrates a perspective view of an embodiment of a connector suitable for use in the connector system of FIG. 1.
Figure 5:
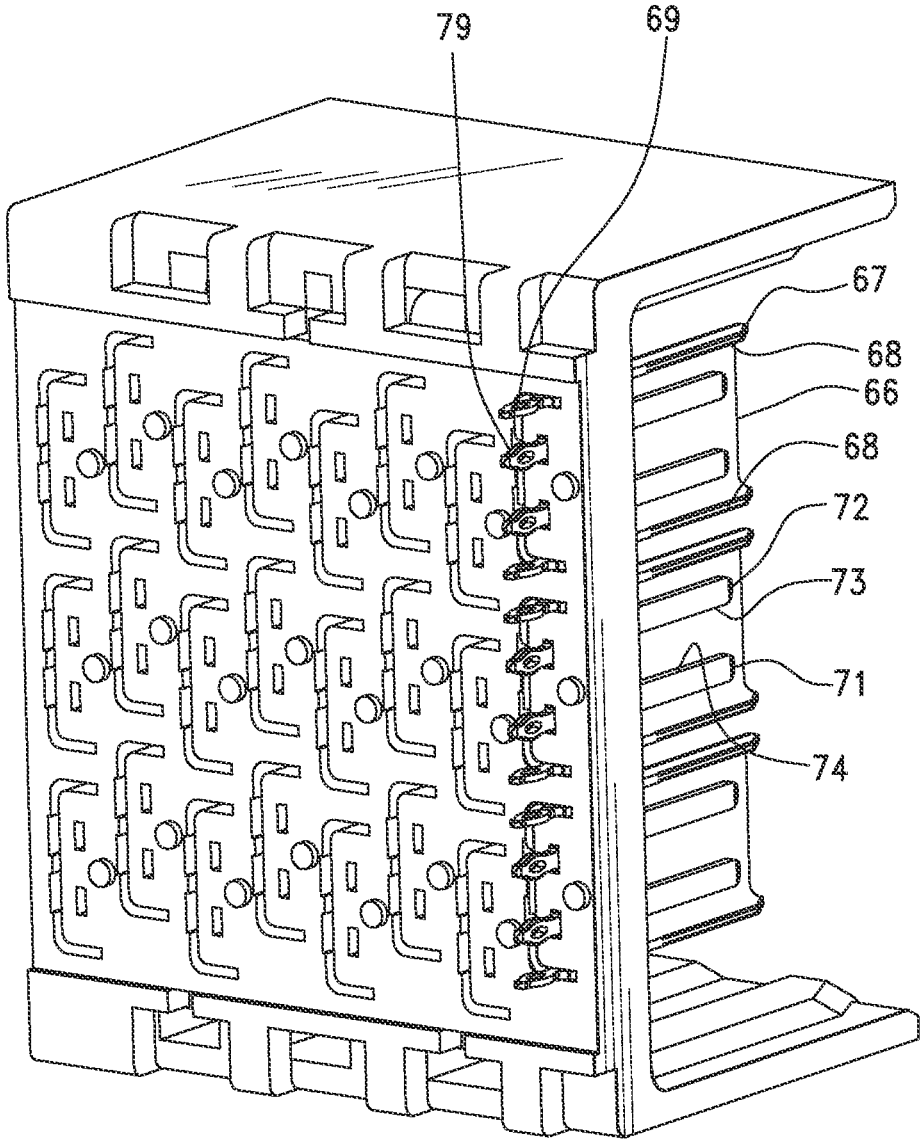
FIG. 5 illustrates another perspective view of the connector depicted in FIG. 4.
Figure 6:
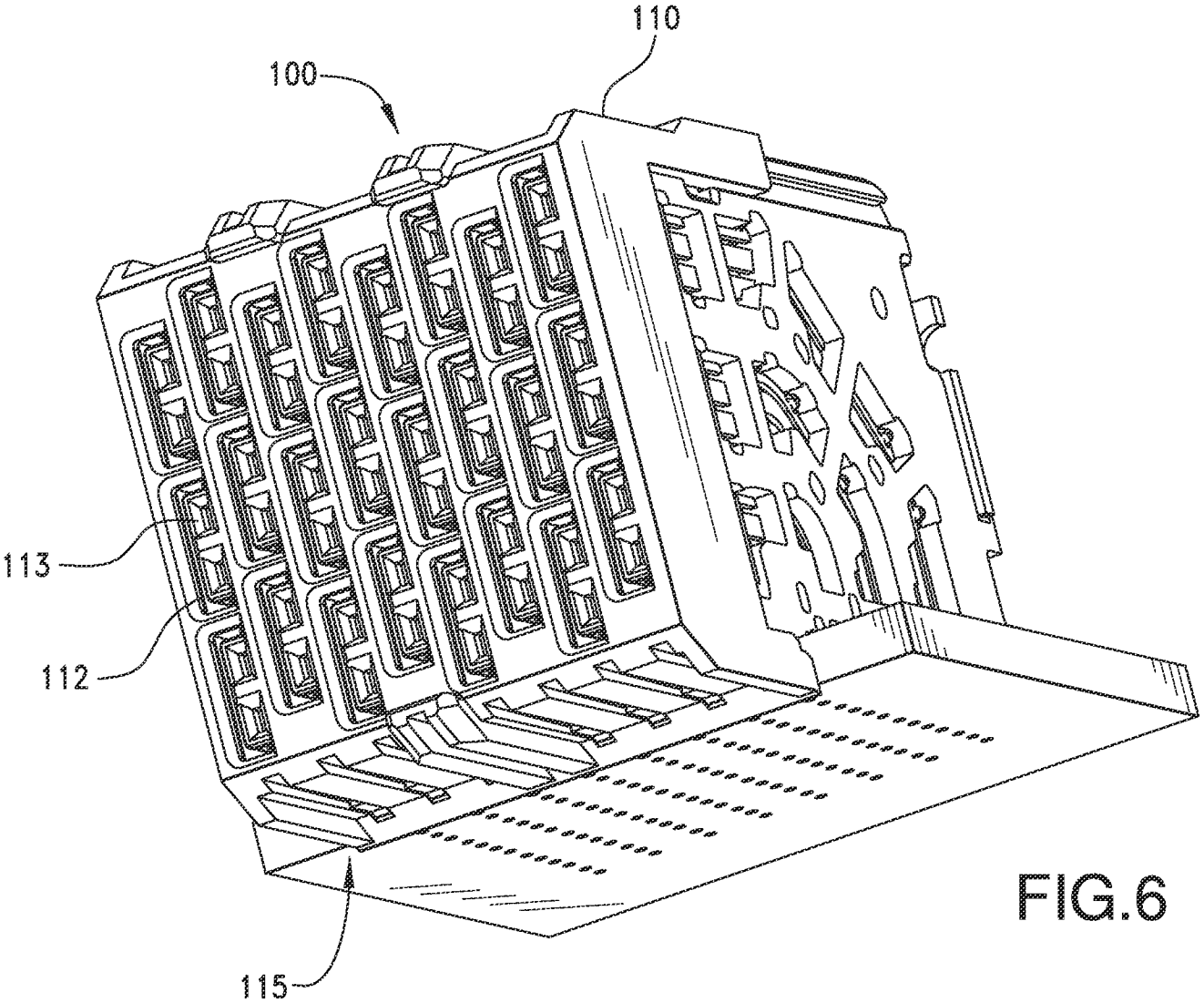
FIG. 6 illustrates a perspective view of an embodiment of a connector suitable for use in the connector system of FIG. 1.
Figure 7:
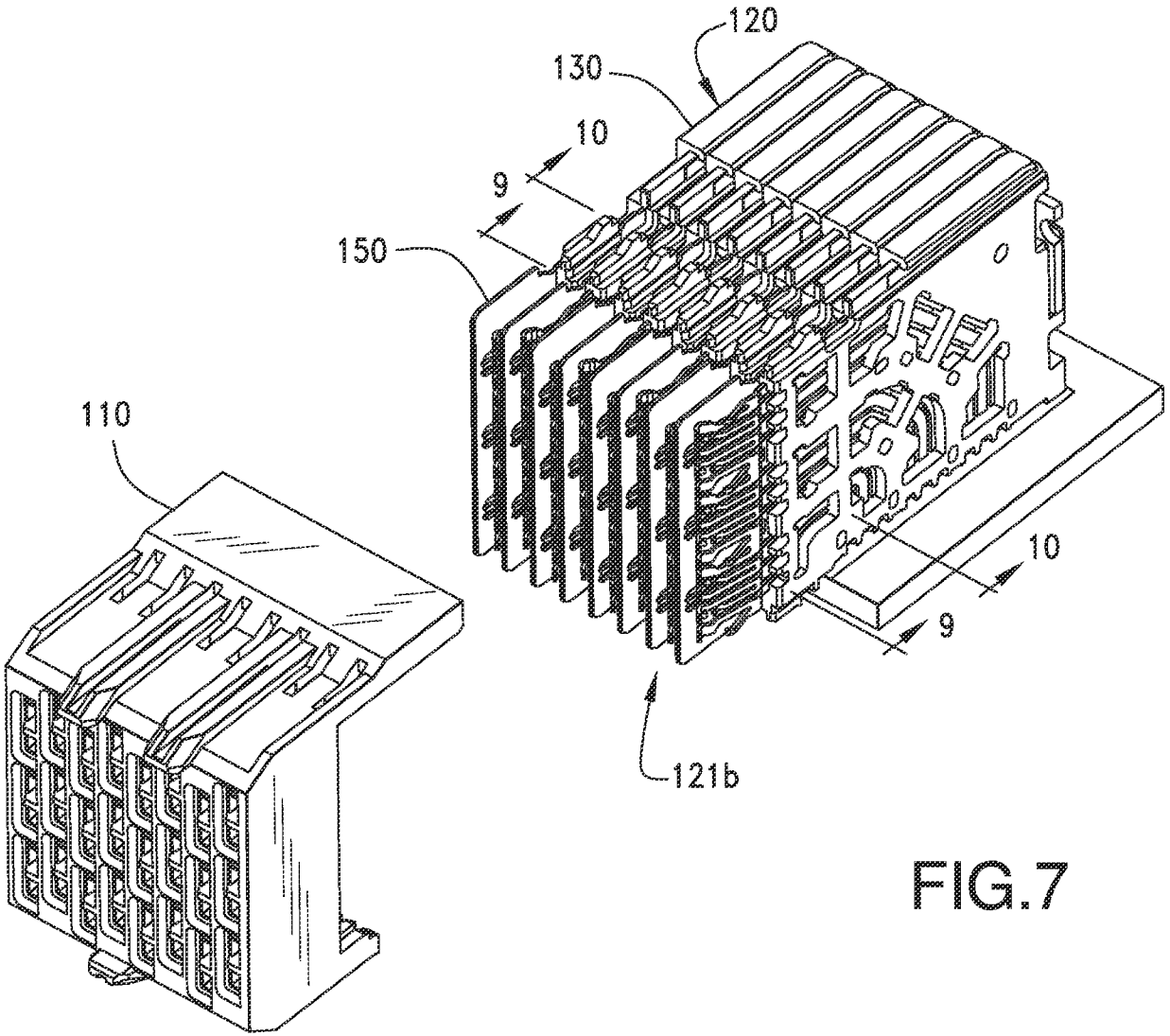
FIG. 7 illustrates a partially exploded perspective view of the connector depicted in FIG. 6.
Figure 8:
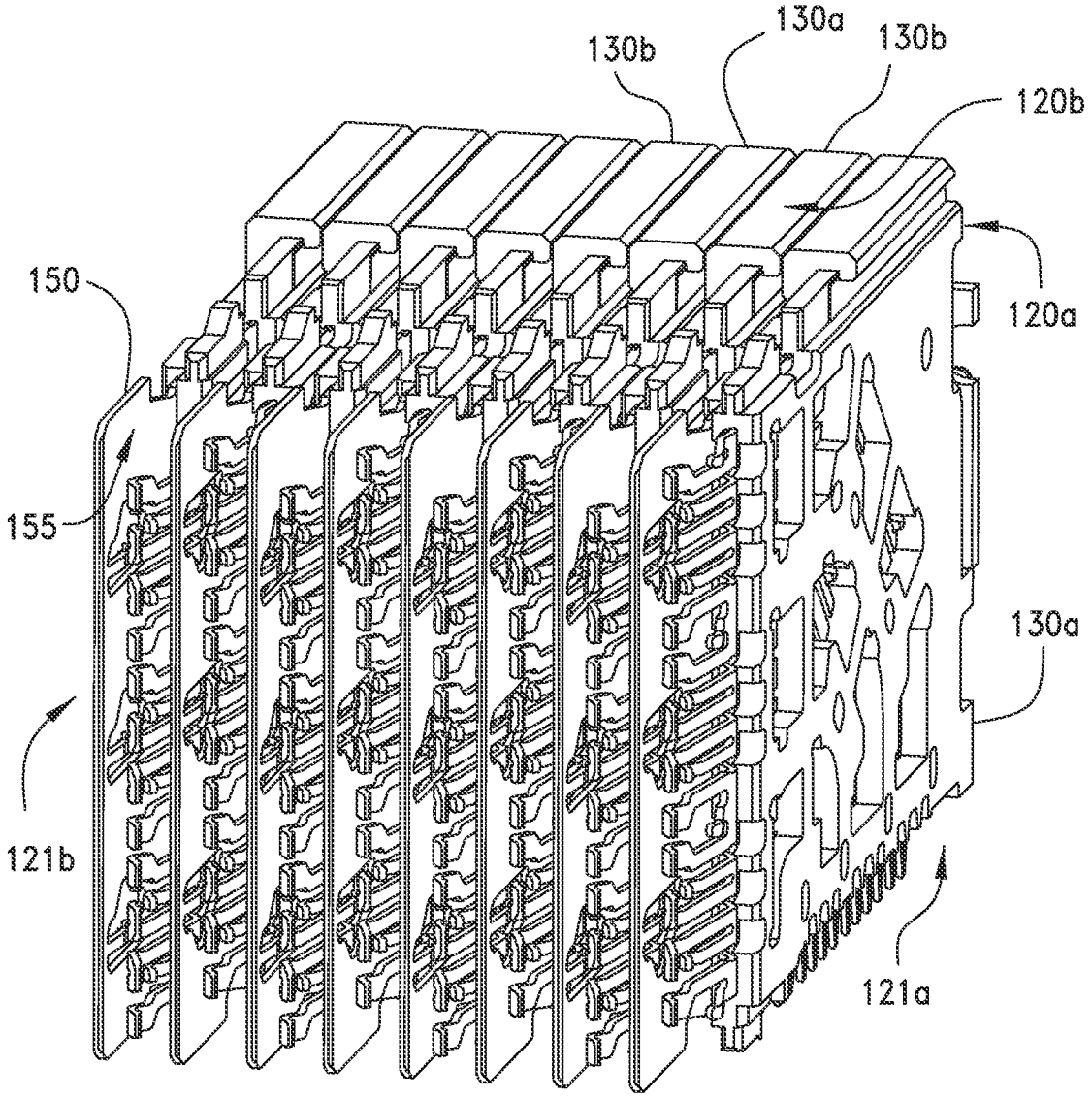
FIG. 8 illustrates a partial perspective view of an embodiment of the connector depicted in FIG. 7.
Figure 9:
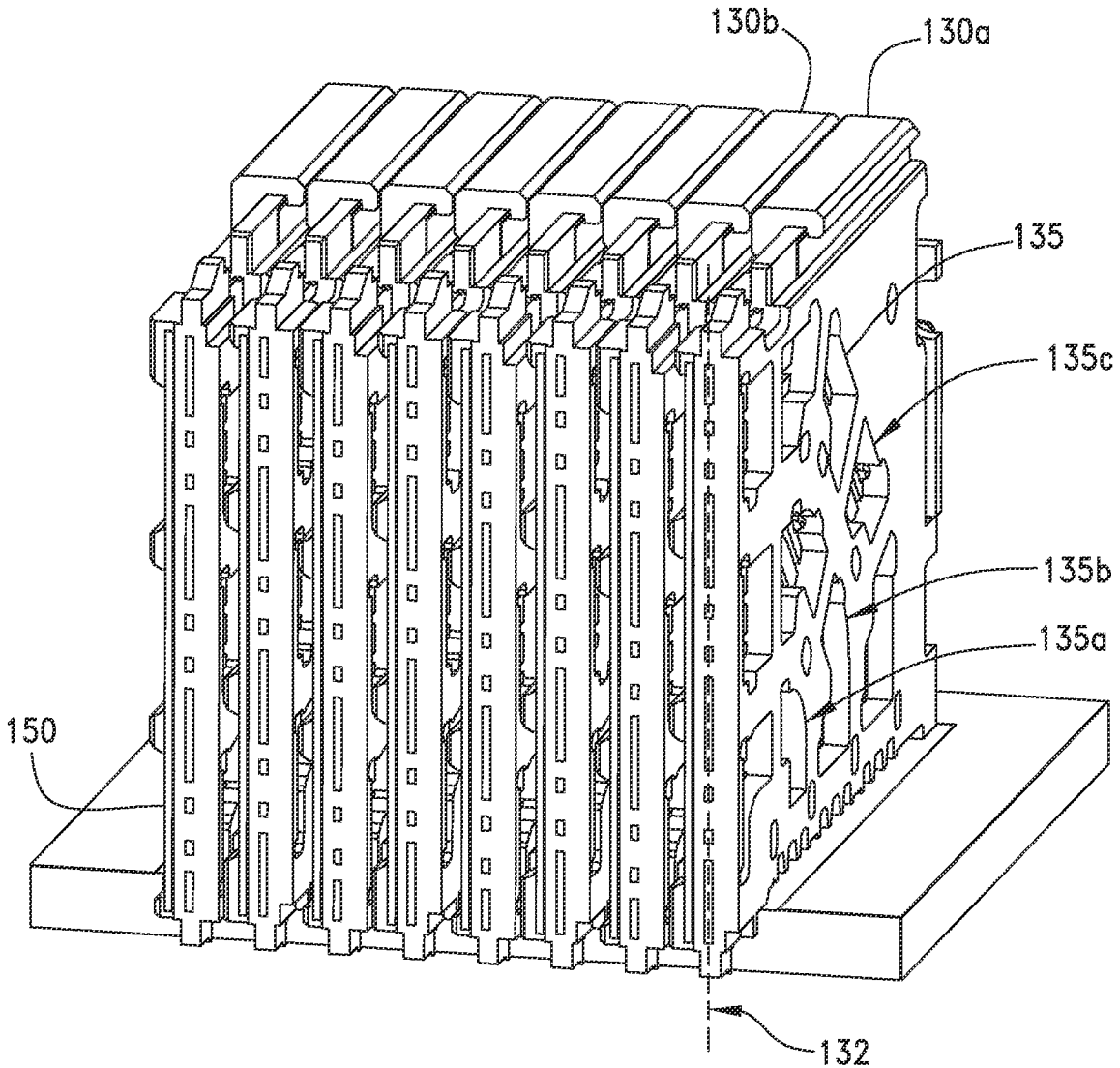
FIG. 9 illustrates a perspective view of a cross-section of the embodiment depicted in FIG. 7, taken along line 9-9.

The detailed description that follows describes exemplary embodiments and is not intended to be limited to the expressly disclosed combination(s). The features of FIGS.

1-18*d* illustrate details that can be used to provide a connector suitable for high data rates. However, not all features are required to provide an appropriate connector. Therefore, unless otherwise noted, features disclosed herein may be removed and/or combined together to form additional combinations that were not otherwise shown for purposes of brevity.

Looking at FIGS. 1-18*d*, a connector system 10 is disclosed that includes a connector 50 (which is an example of what is typically referred to as a header) and a connector 100 (which is an example of what is typically referred to as a daughter card connector). The connector 50 is mounted on a circuit board 22 and the connector 100 is mounted on a circuit board 20. It should be noted that while the connector 100 is depicted as a right-angle connector (with wafer edges at a right angle), it is possible to provide a connector with substantially all the features depicted in connector 100 but have it configured so as to act as a mezzanine-style connector (with edges parallel to each other). Thus, the features of connector 100 are not limited to right angle connectors, unless otherwise noted.

The connector 50 includes a housing 60 that can support an array of terminals 62 that includes channel terminals 65 and blade terminals 71, 72. The housing includes an alignment feature 80 that helps ensure the connector 50 can properly mate with a mating connector.

As can be appreciated, a first channel terminal 65*a* can be positioned adjacent a second channel terminal 65*b*. The number of channel terminals 65 supported by a particular connector 50 will depend on the application. The channel terminal 65 includes a base 66, and wings 67*a*, 67*b* that are positioned on opposite sides of the base 66. Each of the wings includes a mating surface 68. Thus, the edge of the stamped terminal can be used as a mating interface.

The channel terminal 65 includes two tails 69 that are aligned with the wings 67*a*, 67*b*. The blade terminals also each include a tail 79. As depicted, the tails of the blade terminals 71, 72 are orientated differently than the tails of the channel terminal 65. This allows the differential coupling between the edges 73, 74 of the blade terminals to be better maintained through the tails 79 as there is no need to change the orientation of the blade terminals through the housing 60. In addition, the orientation of the wings is also maintained to the tails 69, thus helping to ensure the coupling that takes place between one of the blade terminals and the channel terminal can be desirably managed through the interface. As can be appreciated, the supporting circuit board that the tails are mounted on includes vias that are circular in shape, thus the orientation of the tails does not get in the way of the desired circuit board layout.

Connector 100 includes a housing 110 that supports one or more wafers 120 and the wafers can be further supported with a retaining comb 130. The housing 110 includes ground apertures 112 that receive the channel terminals 65 and includes signal apertures 113 that receive the blade terminals 71, 72. To allow for consistent mating with an opposing connector, an alignment feature 115 is provided. As can be appreciated, the connector 100 includes a first edge 121*a* and a second edge 121*b* that allow the connector to be mounted and mated, respectively. As depicted, the edges are at a right angle to each other.

The wafer 120 includes a housing 130 that supports an optional shield 150. As can be appreciated, the shield 150 includes a front section 155 and rear section 156. The front section 155 is useful to help shield the contacts of terminals (e.g., the mating interface) in adjacent wafers from each other while the rear section 156 shields the body of the terminals. One advantage of maintaining the shield through the interface is that any coupling between the shield and the differential pair that exists can be maintained (thus potentially avoiding conversion of common mode energy to differential mode energy).

As depicted, the wafers 120 are provided in a repeating pattern of a first wafer 120*a* that supports a frame 130*a* and a second wafer 120*b* that supports a frame 130*b*. The wafers 120*a*, 120*b* in the depicted configuration are slightly offset from each other. However, the configuration could be shifted to a full offset (such that ground terminal in one wafer was directly across from the signal pair in an adjacent wafer) or to a configuration with no offset.

Each wafer 120 supports a first signal terminal 181*a* and a second signal terminal 182*a* that together form a signal pair 185*a* that is intended to be differentially edge-coupled. Unlike broadside coupled signal pairs (which tend to be easy to manage from a skew standpoint as both terminals are the same length), edge coupled terminals need to take into account skew management so that the differential signal arrives at both corresponding contacts at approximately the same time. This can be managed in a number of known ways and sometimes is done by controlling the dielectric constant associated with each terminal in the pair so that the electrical length is approximately the same. However, unlike broadside-coupled terminals, it has been determined that it can be easier to control the spacing between edge-coupled signal pairs (in broadside-coupled pairs the two terminals are often supported by two separate frames that must be positioned next to each other and any tolerances between the positioning of the two frames must be accounted for) in certain circumstances.

The depicted wafers provide multiple signal pairs and it should be noted that the number is expected to vary between about 2 and about 16 pairs, depending on the desired configuration of the corresponding application. Between each signal pair 185 a ground terminal 183 is provided. The ground terminal 183 is configured to be wider than one of the signal terminals that form the signal pair 185 and in an embodiment the ground terminal 183 may be configured so that a width W1 associated with a signal pair 185 is less than a width W2 associated with a ground terminal 183.

A signal terminal includes a contact 186*a*, a tail 186*b* and a body 186*c* that extends therebetween. Similarly, a ground terminal includes a ground contact 187*a*, a ground tail 187*b* and ground body 187*c* that extends therebetween. It should be noted that the depicted contacts 186*a* have a double arm contact system that reduces insertion force and improves reliability of the contact mating interface but such a contact system is not required.

As can be appreciated, regardless of the number of terminals, the terminals in each wafer 120 are aligned along a terminal centerline 132. It should be noted, however, that the terminal centerline 132 need not be exactly in the middle of the wafer 120, thus the terminal centerline 132 may or may not be aligned with a wafer centerline.

As noted above, positioned on a side 134 of the wafer 130 is a shield 150. The shield 150 can be configured so that it is aligned with the corresponding frame 130. Thus, shield 150*a* includes grooves 160*a*-160*b* that are aligned with the signal pairs 185*a*-185*b* of frame 130*a* while shield 150*b* includes grooves 170*a*-170*b* that are aligned with the signal pairs supported by frame 130*b*. In each case, the grooves can be formed by providing a wall 174 that includes a series of arms 176 and arms 177 that are formed so as to extend from the wall 174 toward the terminal centerline 132.

Figure 10:
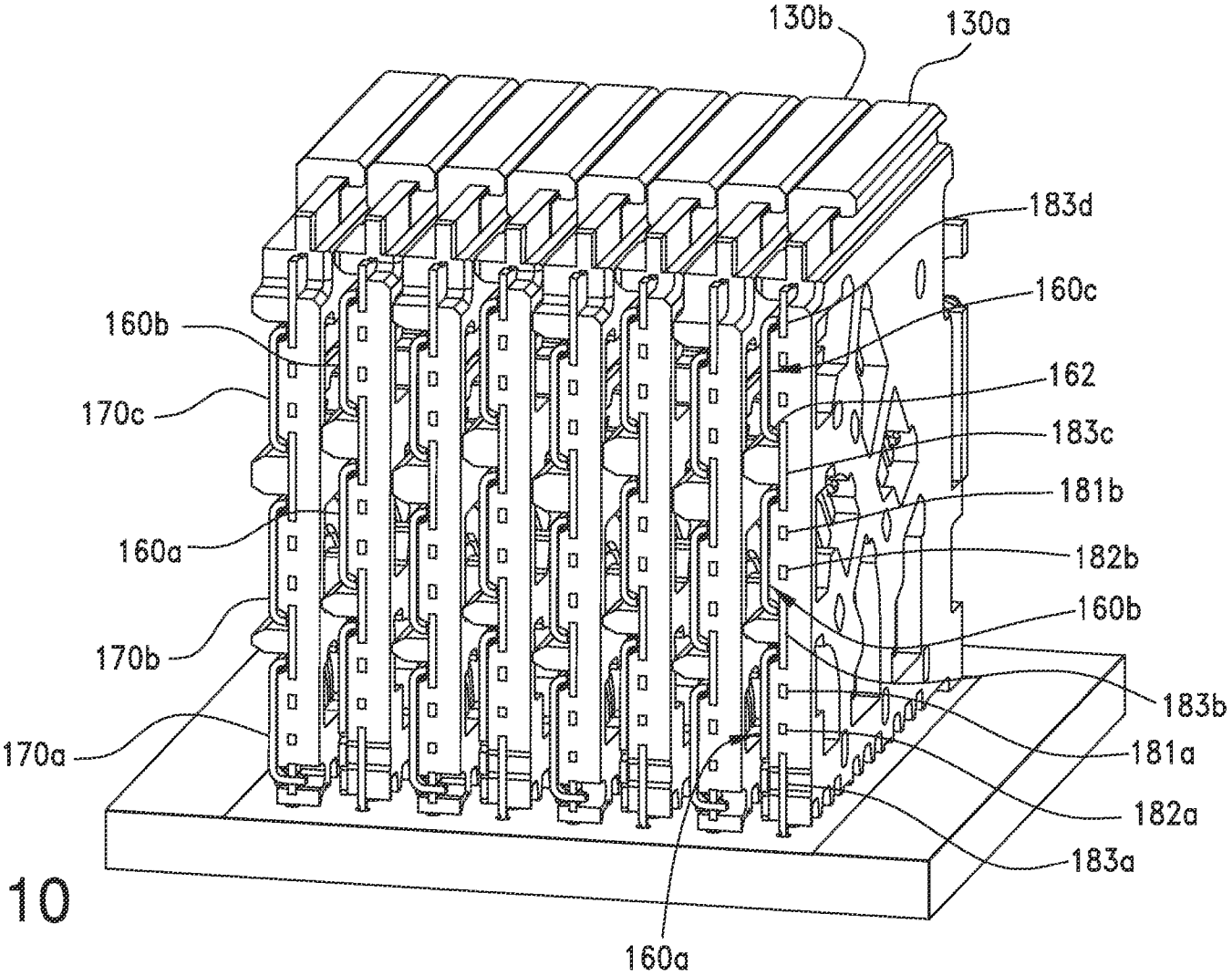
FIG. 10 illustrates a perspective view of a cross-section of the embodiment depicted in FIG. 7, taken along line 10-10.
Figure 11:
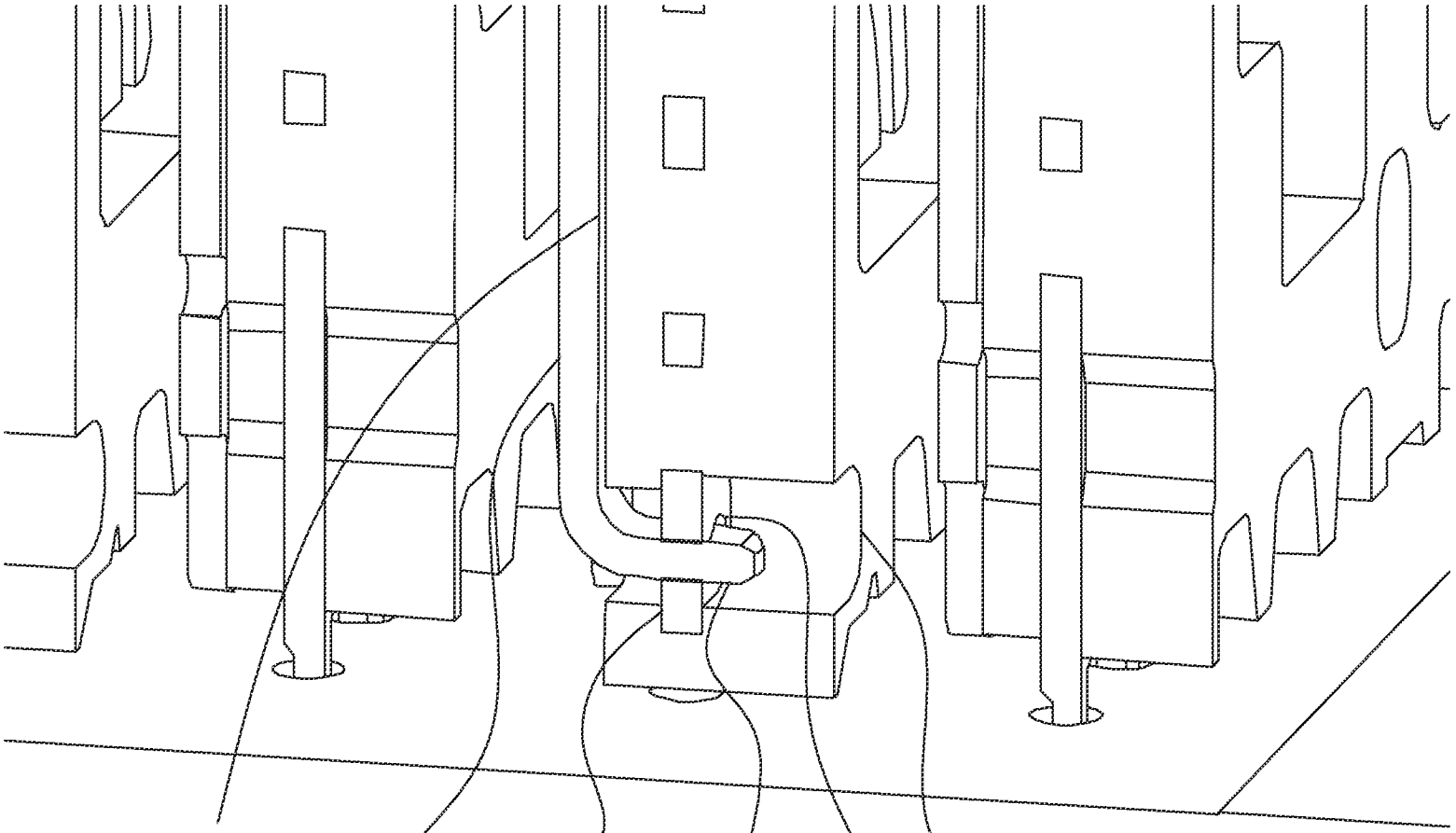
FIG. 11 illustrates an enlarged view of the embodiment depicted in FIG. 10.
Figure 12:
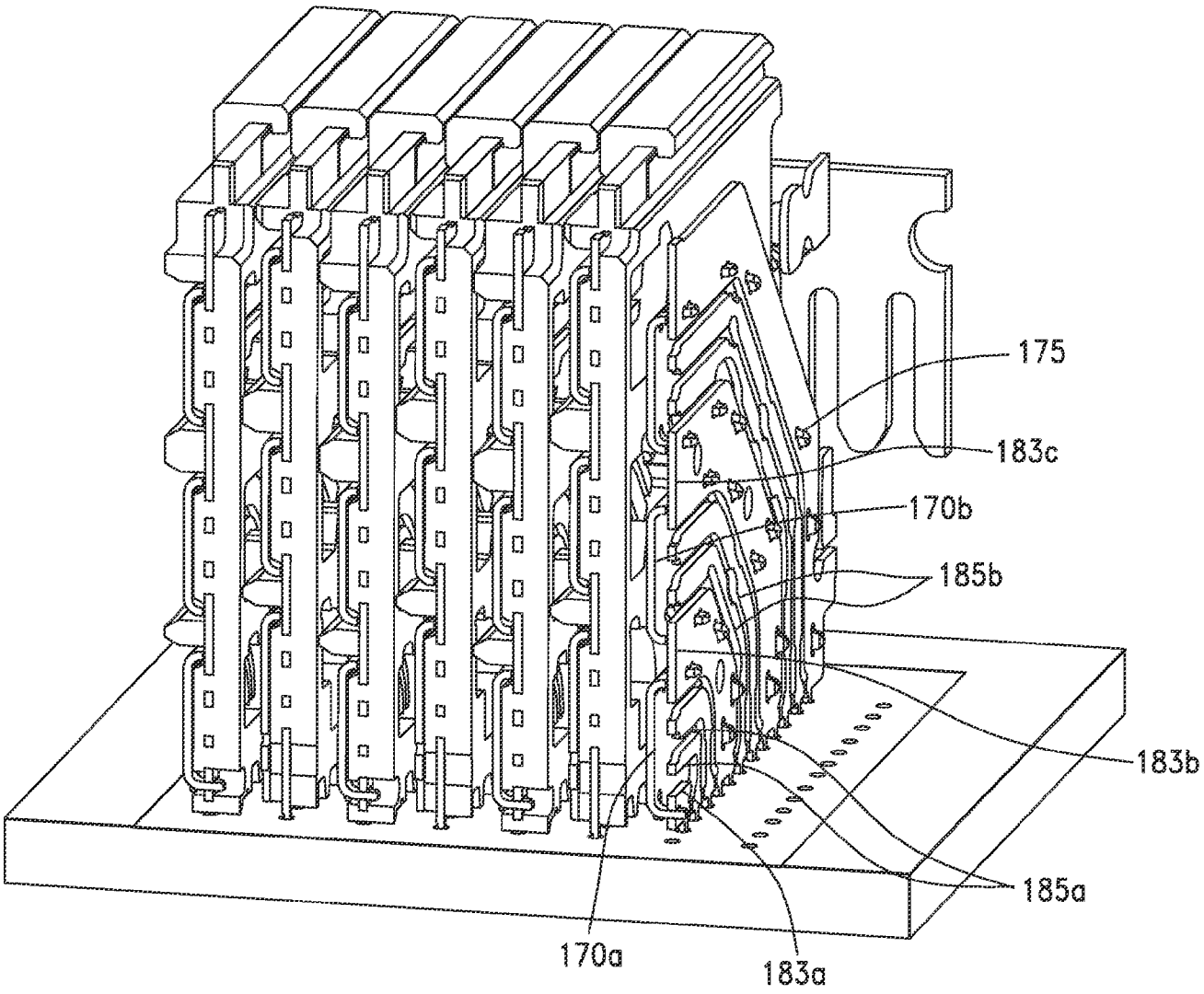
FIG. 12 illustrates a partial perspective view of the embodiment depicted in FIG. 10.
Figure 13:
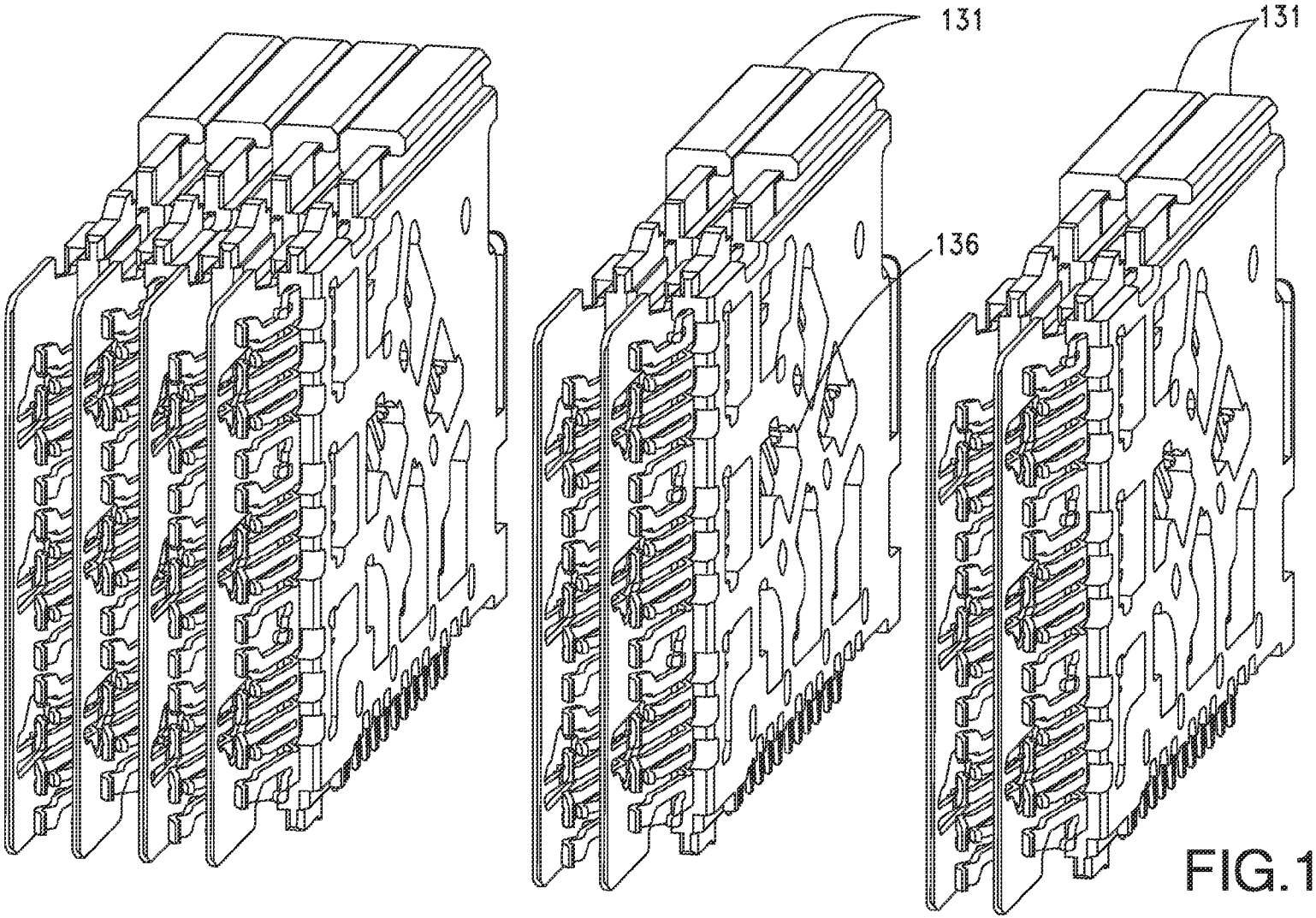
FIG. 13 illustrates a partially exploded view of the embodiment depicted in FIG. 8.
Figure 14:
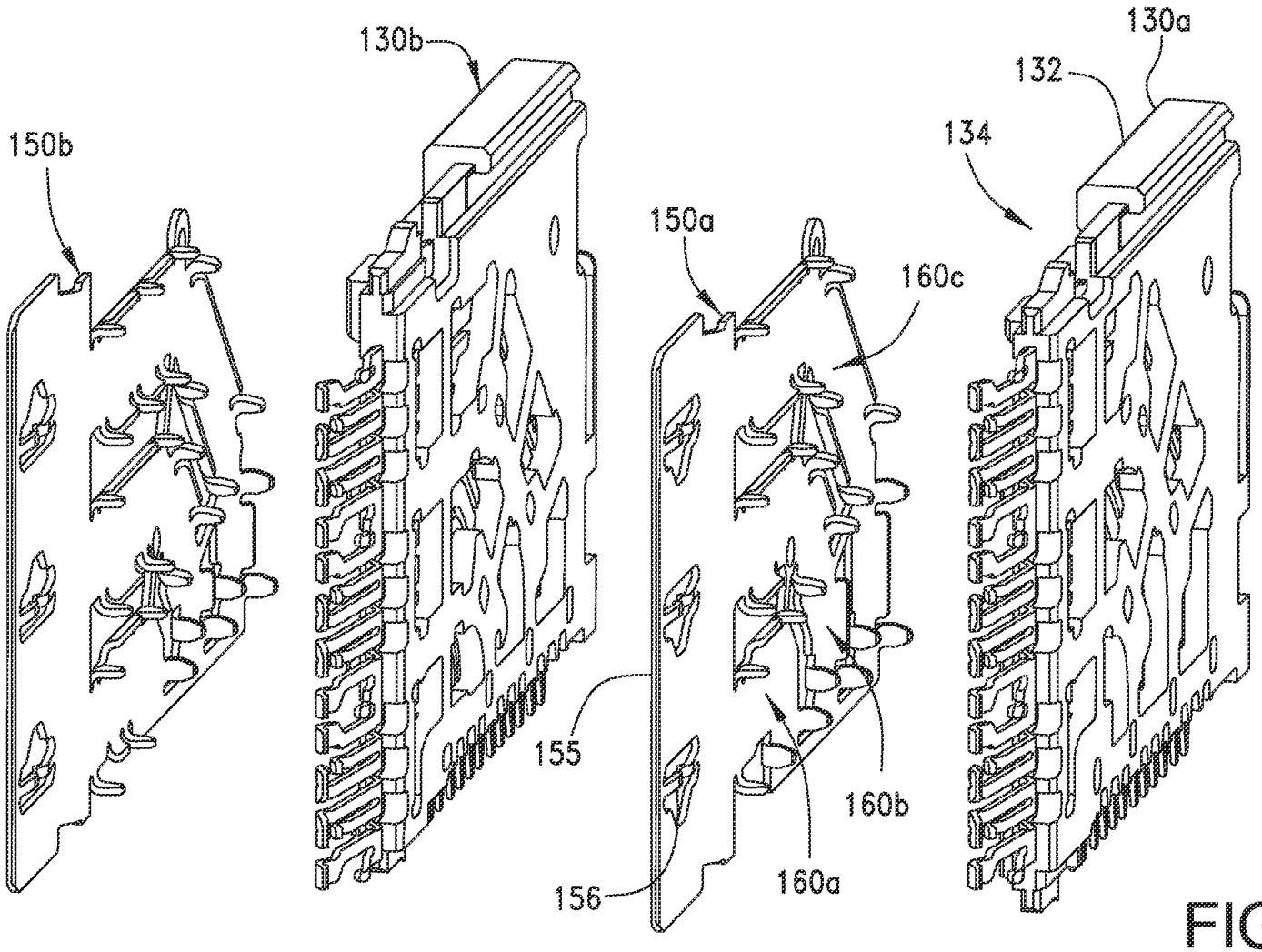
FIG. 14 illustrates a simplified, perspective exploded view of two adjacent wafers that can be used in a connector.
Figure 15:
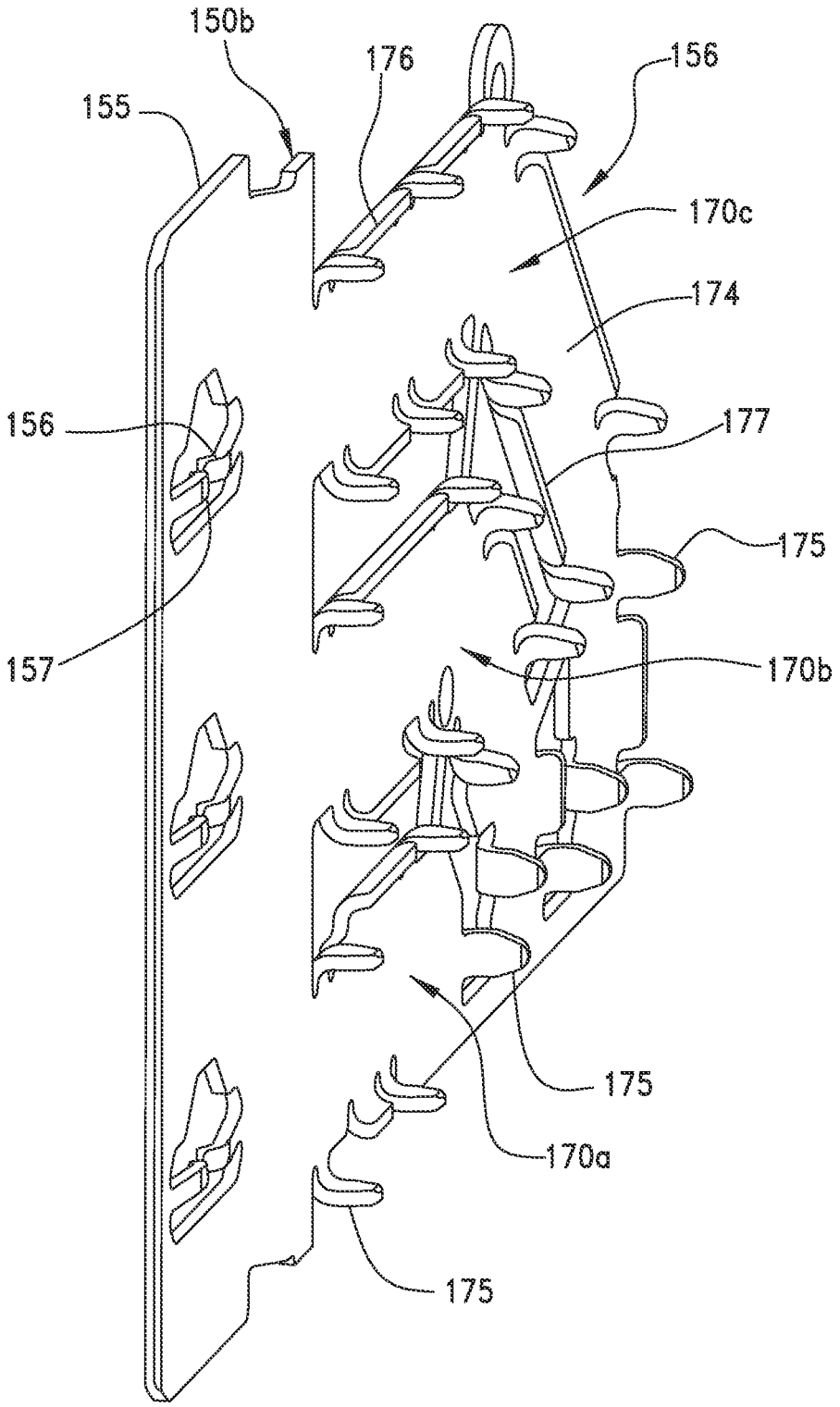
FIG. 15 illustrates a perspective view of an embodiment of a shield that can be used with a wafer.
Figure 16:
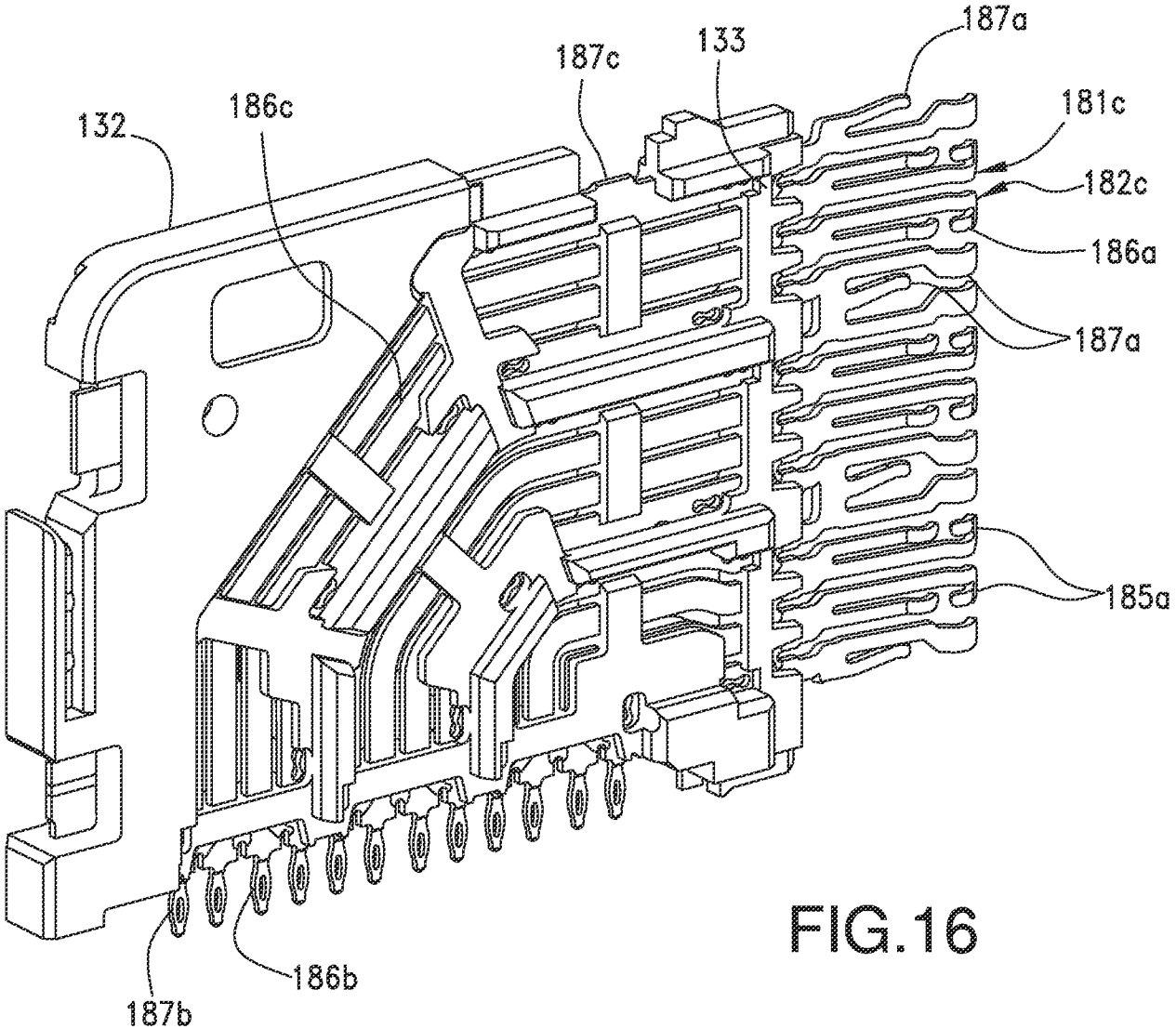
FIG. 16 illustrates a perspective view of an embodiment of a wafer without a shield.
Figure 17:
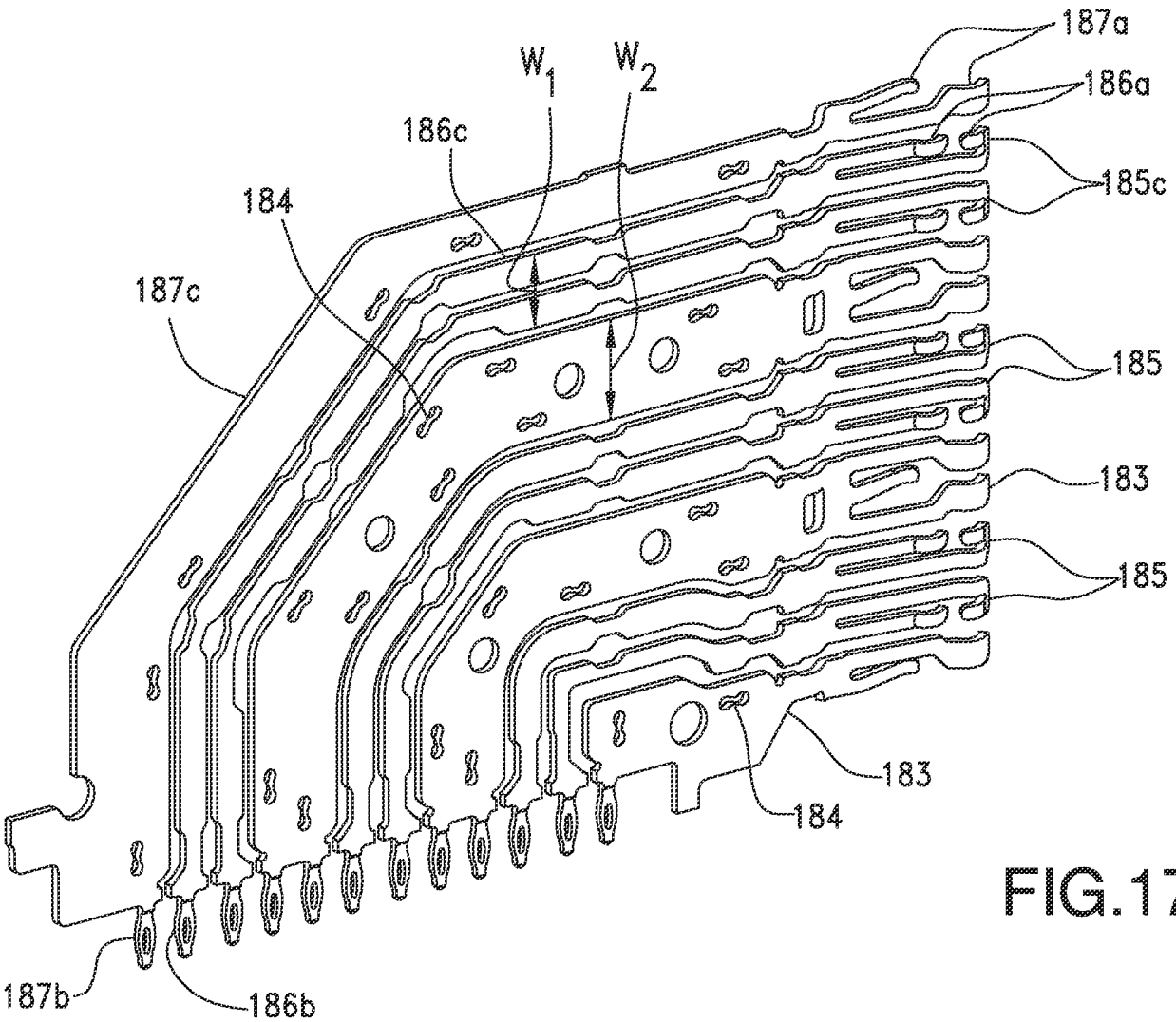
FIG. 17 illustrates a perspective view of the wafer depicted in FIG. 16 with the frame omitted.
Figure 18A:
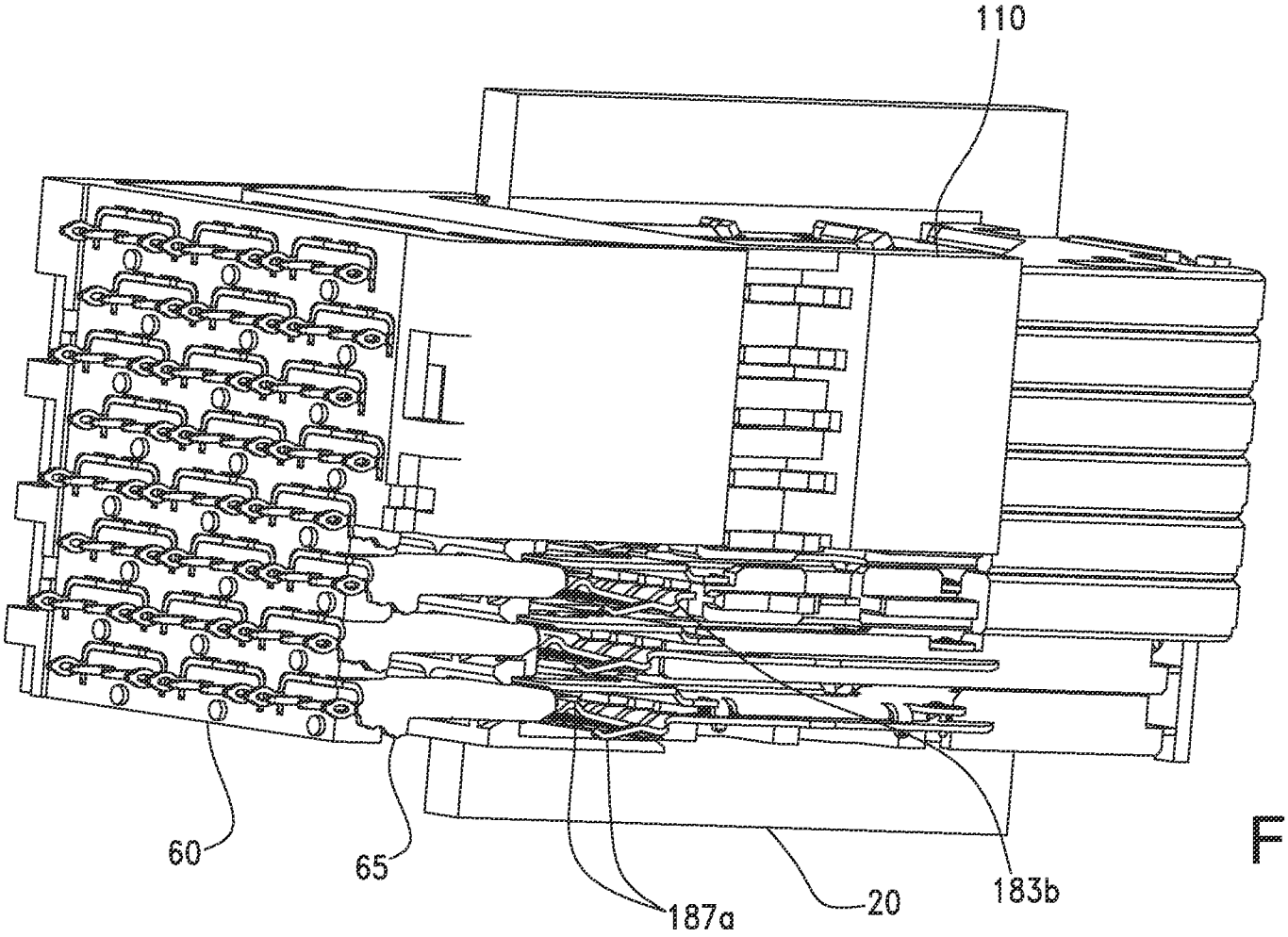
FIG. 18*a* illustrates a partial perspective view of a connector system during a mating cycle.
Figure 18B:
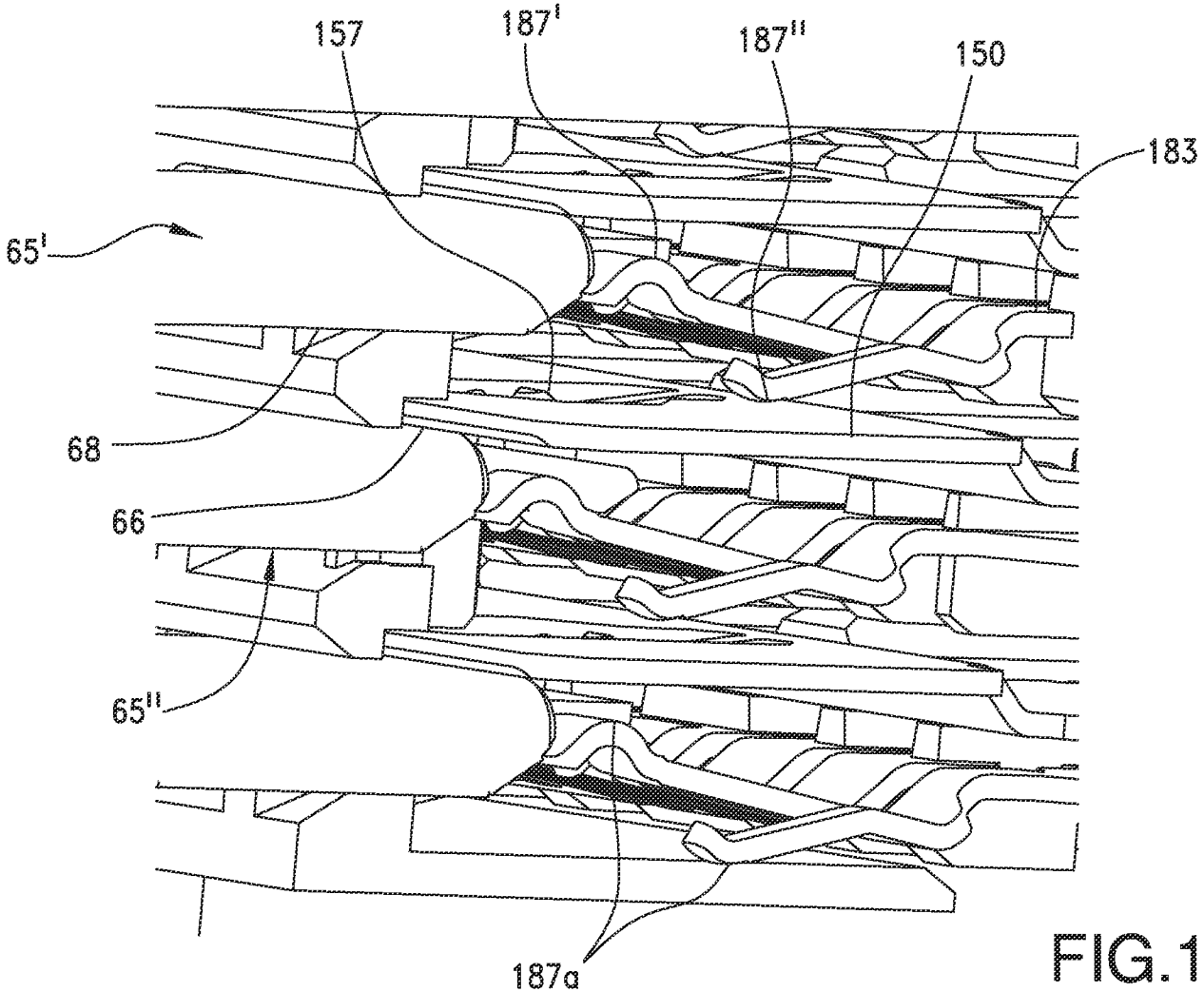
FIG. 18*b* illustrates an enlarged view of the embodiment depicted in FIG. 18*a*.
Figure 18C:
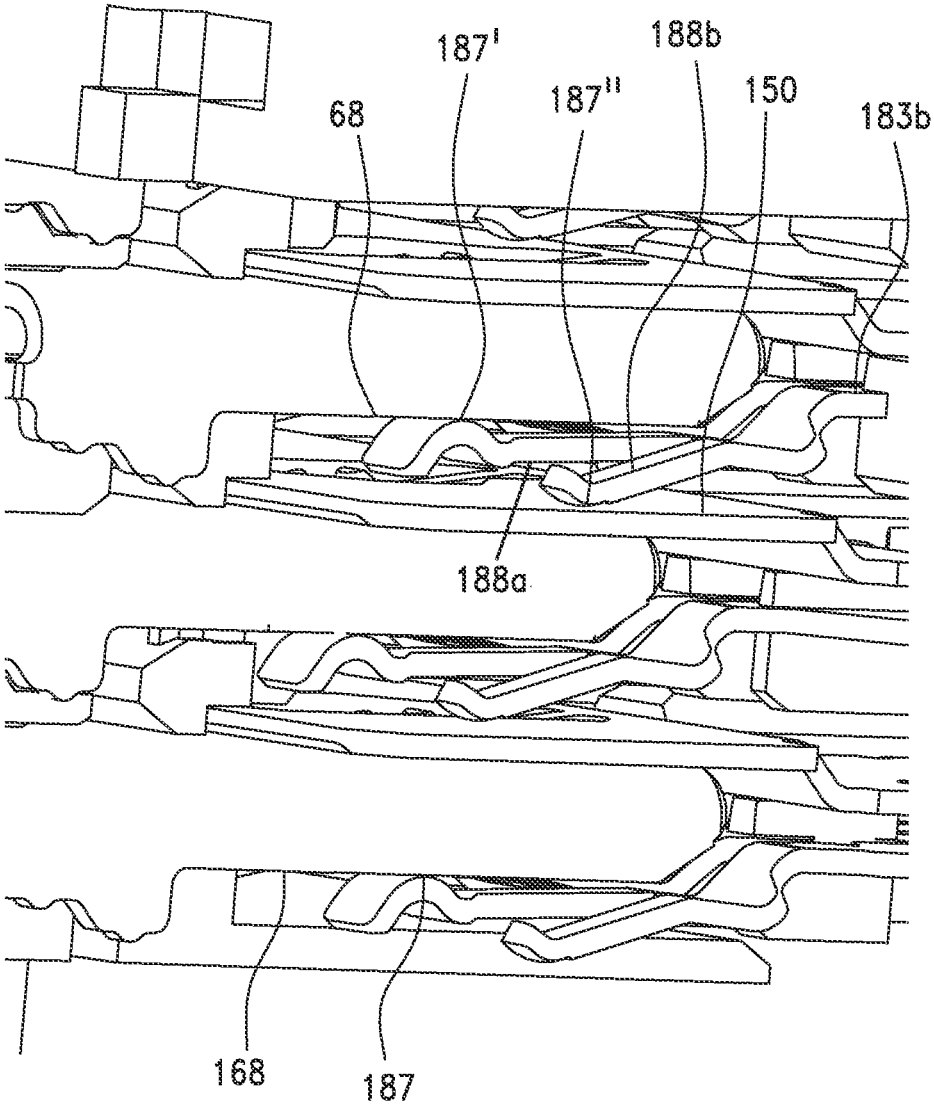
FIG. 18*c* illustrates a perspective view of the embodiment depicted in FIG. 18*b* with the connector system in a mated position.
Figure 18D:
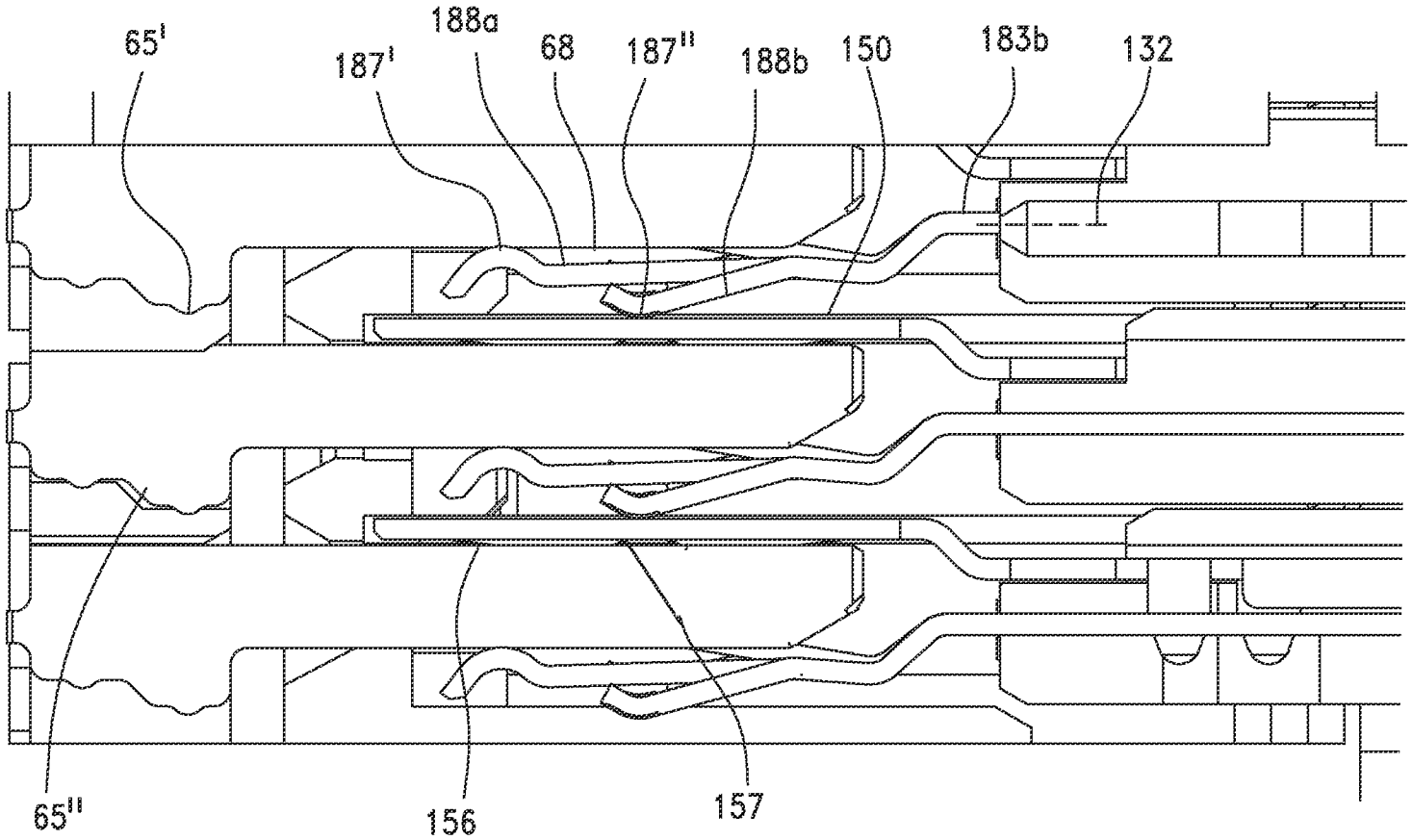
FIG. 18*d* illustrates an elevated side view of the embodiment depicted in FIG. 18*c*.

To improve electrical performance, the shield can further include a plurality of fingers 175 that are configured to engage apertures 184 in the ground terminal 183 (such as ground terminal 183*d*) so as to create electrical connections therebetween (rather than relying on capacitive coupling between the ground terminals and the shield). This allows the ground terminals to be commoned with the shield and helps prevent resonances at frequencies of interest that can otherwise occur when the electrical length of the ground terminals is increased due to the lack of commoning. In addition, as depicted, the groove extends between and commons two ground terminals 183 that are positioned on opposite sides of a signal pair 185. While the use of commoning elements is known, the depicted embodiment can provide improved performance by aligning the arms 176, 177 with the fingers 175 so that the groove can provide substantial shielding over 180 degrees (as is depicted in FIG. 10). To allow for a press-fit/interference fit type engagement, notches 136 can be provided in the frame 130 so as to allow the shield 150 to be attached to the frame 130.

As depicted, the frame 130 includes air recesses 135 that are aligned with signal pairs 185. For example, air recesses 135*a*-135*c* can be aligned with signal pairs 185*a*-185*c*, respectively. The use of the air recess 135 helps reduce the effective dielectric constant of corresponding signal pair (which can help reduce the electrical length). Naturally, it is less desirable from a manufacturing and structural standpoint to have a continuous air recess and therefore the air recesses have occasional webs of the frame intersecting them. To minimize impedance discontinuities, the terminals can be notched at the location of the webs.

One issue, as noted above, with existing connectors is that it has been difficult to provide a connector that can support high data rates such as 25 Gbps or greater using non-return to zero (NRZ) encoding while also providing a dense pin field. The depicted connector system provides features that help resolve this issue. As can be appreciated, the ground contact 187 includes a beam 188*a* that has a contact surface 187' that engages the mating edge 68 of the channel terminal 65. Thus, unlike convention systems, the mating interface depicted herein has the ground contact mate to an edge of a corresponding terminal.

Figure 19A:
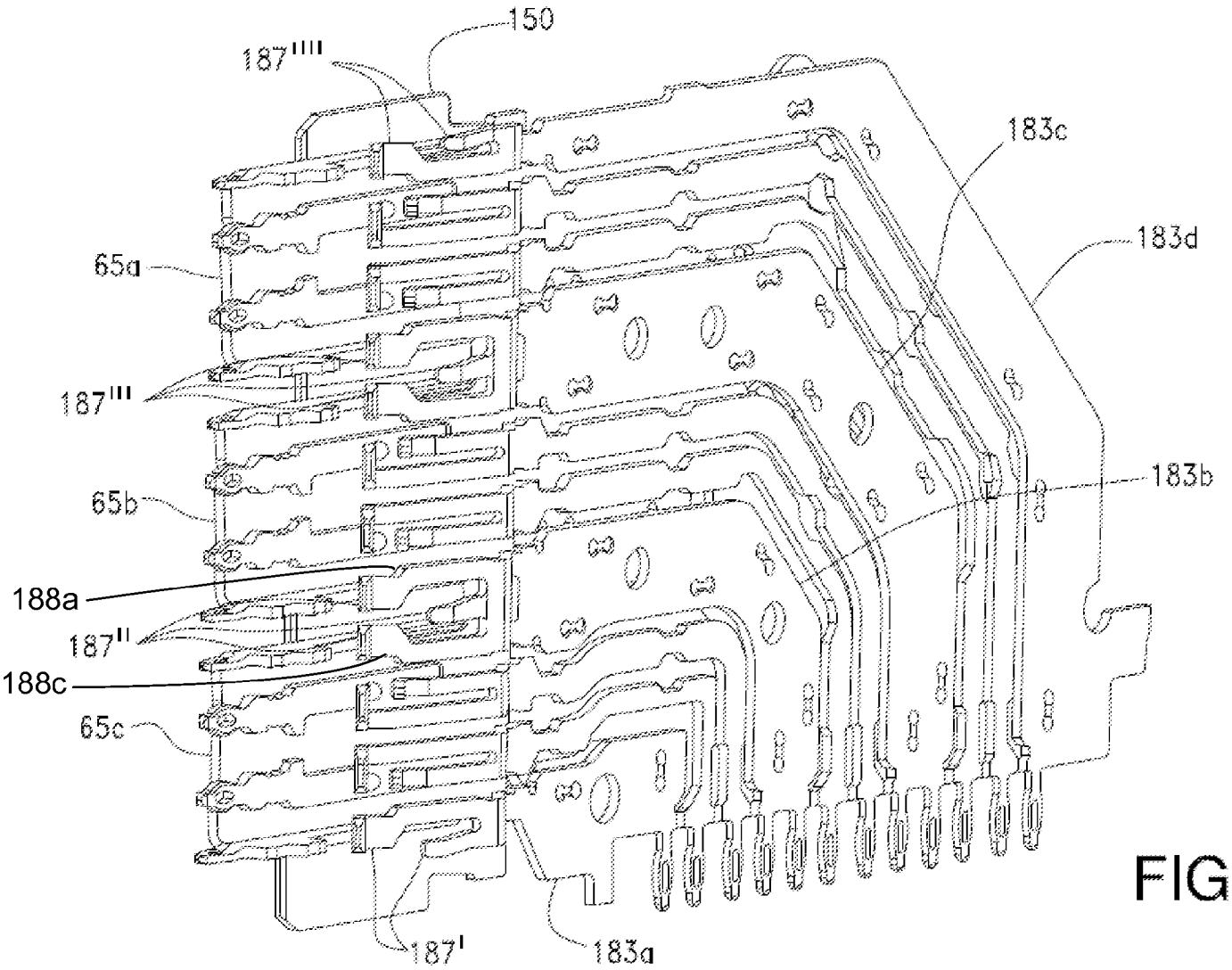
FIG. 19*a* illustrates a perspective simplified view of an embodiment of two connectors mated together.

To provide additional performance enhancements, the ground contact may include a beam 188*b* that has a contact surface 187" that faces the opposite direct of the contact surface 187'. In addition, as depicted in FIG. 19*a*, the ground contact 187 can include a beam 188*c* that engages a mating edge 68 like the beam 188*a* does but is positioned on an opposite side of the beam 188*b*. This allows the ground contact to be electrically connected to the channel terminal 65 and the shield 150 (thus helping common the ground/reference voltage provided by the ground terminal and the shield). The shield 150 may also include a ground finger, such as grounding fingers 156 and 157 that can be used to common the shield 150 to another channel terminal 65. Thus, as depicted, channel terminal 65' is commoned to channel terminal 65" via an electrical connection between surface 68 of channel terminal 65' and contact surface 187' of ground terminal 183*b* and the electrical connection between contact surface 187" and shield 150, which is in turn electrically connected to channel terminal 65" via grounding fingers 156 and 157. Or, to put it another way, two channel terminals can be electrically commoned via an electrical path that extends between the two channel terminals via a ground contact and a shield.

Figure 20:
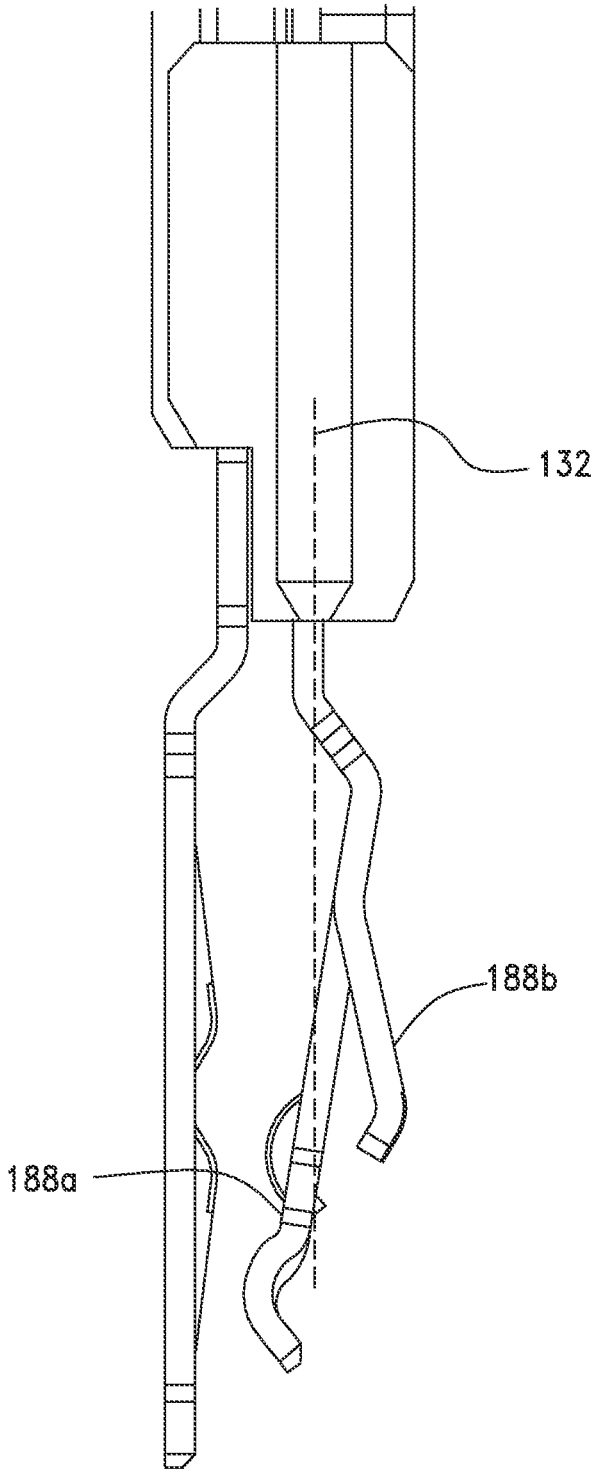
FIG. 20 illustrates a plan view of an embodiment of a wafer.

As can be appreciated, the optional beam 188*b* (which allows the ground contact on one wafer to be electrically coupled to a shield of an adjacent wafer) provides further electrical benefits. And, as can be appreciated from FIG. 20, prior to mating the beam 188*a* extends at an angle in a first direction from the terminal centerline 132 while the beam 188*b* extends at an angle in a second direction from the terminal centerline 132. And once the connectors are mated, as can be appreciated from FIG. 18*d*, the contact surfaces supported by both beams 188*a*, 188*b* are positioned on the same side of the terminal centerline 132 (even if they are still facing opposite directions). Thus, the depicted ground contact can include features that have a beneficial impact on the electrical performance of the connector.

Figure 19B:
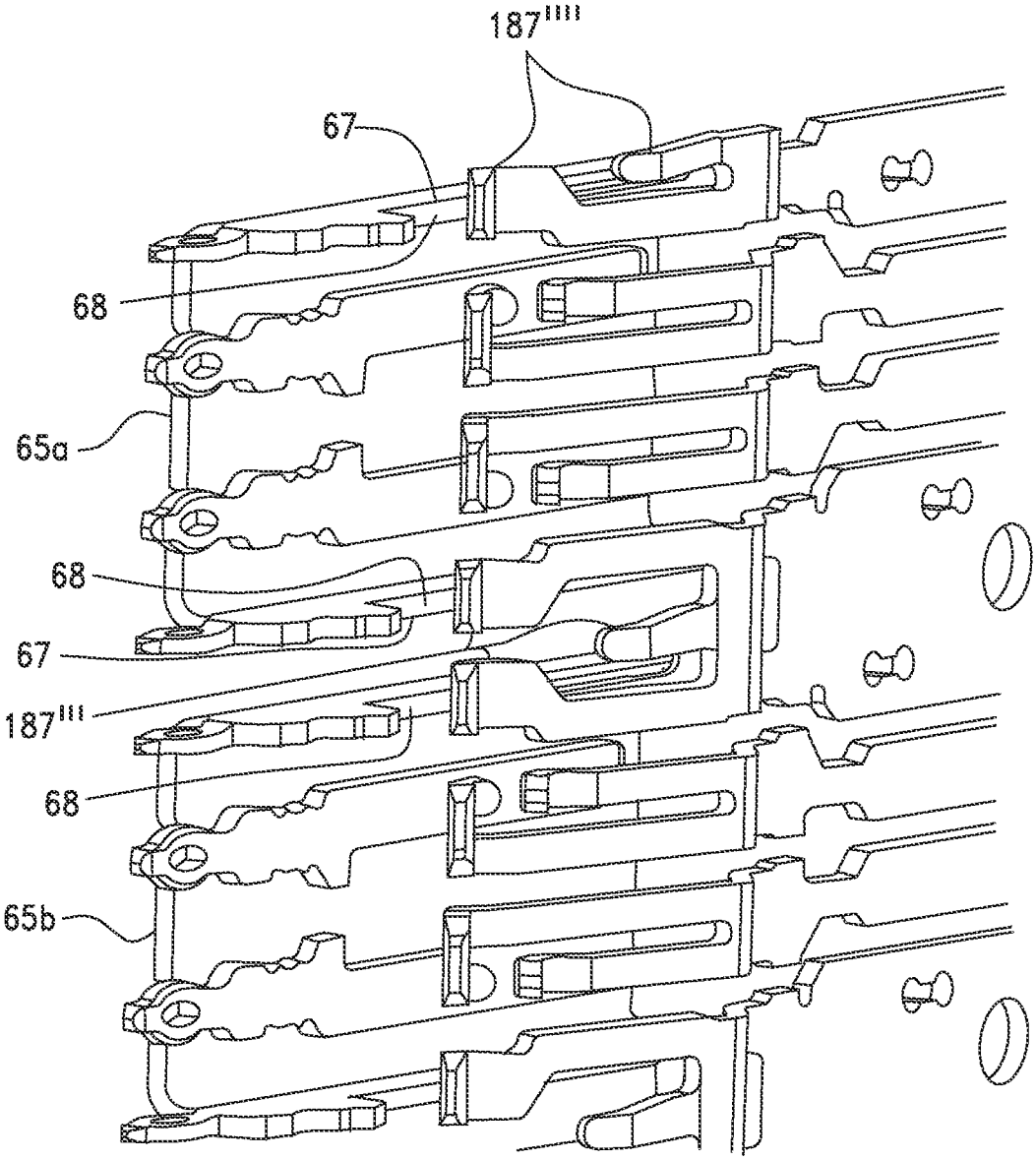
FIG. 19*b* illustrates an enlarged view of the embodiment depicted in FIG. 19*a*.

In an embodiment, as depicted in FIGS. 19*a*-19*b*, ground terminals 183*a*-183*d* are provided. The ground terminals 183*a*-183*d* have ground contacts 187'-187"", respectively. Each ground contact engages a mating edge 68 of one of the channel terminals 65*a*-65*c*. As can be appreciated, one advantage of the depicted system is that ground contacts 187''' and 187"" are commoned by channel terminal 65*a*. This helps ensure the ground terminals and associated channel terminals do not have resonances at undesirable frequencies. Furthermore, to help avoid resonances the ground contact 187''' can be electrically connected to two different channel terminals because of its two beams that are each configured to be electrically connected to a different channel terminal, and more specifically to a different edge of a channel terminal. As can be appreciated, one benefit of having the ground terminals electrically connected to mating edges is the conservation of space in the connector 50 while allowing for commoning between ground terminals via the fact that two different ground terminals are electrically connected to the same channel terminal.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing having a mating face;

a wafer supported by the housing, the wafer having a first edge and a second edge and a first side;

a pair of signal terminals supported by the wafer, each of the terminals in the signal pair having a contact extending from the first edge, a tail extending from the second edge and a body extending between the contact and the tail, the pair of signal terminals being arranged in an edge-to-edge alignment;

a ground terminal supported by the wafer and positioned adjacent the pair of signal terminals, the ground terminal having a ground contact, a ground tail and a ground body extending between the ground contact and the ground tail, the ground terminal and the pair of signal terminals forming a single column; and a shield supported by the wafer on the first side, the shield having a groove with two arms formed in the shield, the groove aligned with the pair of signal terminals so that the two arms are positioned on opposite sides of the signal pair.

2. The connector of claim 1, wherein the groove extends substantially along the body of the pair of signal terminals from the first edge to the second edge.

3. The connector of claim 1, wherein the ground terminal is a first ground terminal, the connector further comprising a second ground terminal positioned adjacent the pair of signal terminals opposite the first ground terminal and the shield electrically connected to the first and second ground terminals.

4. The connector of claim 3, wherein the first and second ground terminals include apertures positioned along the body and the shield includes fingers that engage the apertures in the first and second ground terminals with in an interference fit.

5. The connector of claim 3, wherein the wafer supports a plurality of pairs of signal terminals with a corresponding ground terminal positioned between each pair of signal terminals, the shield having a corresponding groove aligned with each of the plurality of pairs of signal terminals.

6. The connector of claim 1, wherein the ground contact has a first beam with a first contact surface that faces a first direction and the ground contact has a second beam with a second contact surface that faces a second direction that is different than the first direction.

7. The connector of claim 1, wherein the first edge and the second edge are at a right angle to each other.

8. A connector, comprising:

a housing having a mating face;

a wafer supported by the housing, the wafer having a first edge and a second edge;

a pair of signal terminals supported by the wafer, each of the terminals in the signal pair having a contact extending from the first edge, a tail extending from the second edge and a body extending between the contact and the tail, the pair of signal terminals being arranged in an edge-to-edge alignment, the signal terminals configured to engage the blade terminals; and a ground terminal supported by the wafer and positioned adjacent the pair of signal terminals, the ground terminal having a ground contact, a ground tail and a ground body extending between the ground contact and the ground tail, the ground terminal and the pair of signal terminals forming a single column, wherein the ground body defines a terminal centerline and the ground contact has a first beam that extends at a first angle on a first side of the terminal centerline and further includes a second beam that extends at a second angle on a second side of the terminal centerline.

9. The connector of claim 8, wherein the ground contact is wider than the contacts of the pair of signal terminals.

10. The connector of claim 8, wherein the ground contact includes a third beam that extends at the first angle on the first side of the terminal centerline, the first and third beam positioned on opposite sides of the second beam.

11. The connector of claim 10, wherein the first beam is configured to engage a first mating surface and the second beam is configured to engage a second mating surface that faces the first mating surface.

12. A connector system, comprising:

a first housing;

a first and a second blade terminal supported by the first housing, the blade terminals aligned edge to edge;

a first channel terminal supported by the first housing, the first channel terminal having a base and two wings extending from the base so as to provide a U shape, the wings having mating edges;

a second housing having a face configured to mate with the first housing;

a wafer supported by the second housing, the wafer having a first side and a second side;

a pair of signal terminals supported by the wafer, each of the terminals in the signal pair having a contact extending from the first side, a tail extending from the second side and a body extending between the contact and the tail, the pair of signal terminals being arranged in an edge-to-edge alignment, the signal terminals configured to engage the blade terminals; and a ground terminal supported by the wafer and positioned adjacent the pair of signal terminals, the ground terminal having a ground contact, a ground tail and a ground body extending between the ground contact and the ground tail, wherein the ground terminal and the pair of signal terminals forming a single column and the ground contact engages one of the mating edges.

13. The connector system of claim 12, wherein the first housing supports a second channel ground with a second mating edge positioned adjacent the first channel ground and the ground contact has a first beam and a second beam, the first beam engaging the mating edge and the second beam engaging the second mating edge of the second ground channel.

14. The connector system of claim 12, further comprising a second channel terminal supported by the first housing, the second channel terminal having a base and two wings extending from the base so as to provide a U shape, the wings having mating edges wherein one of the mating edges of the first channel terminal is positioned adjacent one of the mating edges of the second channel terminal.

15. The connector system of claim 14, wherein the ground terminal includes a first and second beam, the first beam engaging one of the mating edges of the first ground channel and the second beam engaging one of the mating edges of the second ground channel.

16. The connector system of claim 15, further including a shield supported by the wafer, the shield including a groove formed in the shield, the groove aligned with pair of signal terminals.

17. The connector system of claim 16, wherein the shield is electrically connected to the ground terminal.

18. The connector system of claim 12, further including a shield supported by the wafer, the shield including a groove formed in the shield, the groove aligned with the pair of signal terminals.

19. The connector system of claim 18, wherein the shield includes a plurality of fingers and the ground terminal includes a plurality of apertures and the fingers are pressed into the apertures so that the shield is electrically connected to the ground terminal.

20. The connector system of claim 12, wherein the ground terminal is a first ground terminal and the wafer further includes a second ground terminal, the second ground terminal including a ground contact that engages the other of the mating edges.

* * * * *